US007717089B2

(12) United States Patent
Oda et al.

(10) Patent No.: US 7,717,089 B2
(45) Date of Patent: May 18, 2010

(54) HIGH PRESSURE PUMP HAVING SOLENOID ACTUATOR

(75) Inventors: Kaoru Oda, Toyokawa (JP); Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/410,253

(22) Filed: Apr. 25, 2006

(65) Prior Publication Data

US 2006/0239846 A1 Oct. 26, 2006

(30) Foreign Application Priority Data

Apr. 26, 2005 (JP) ..... 2005-127743
Oct. 24, 2005 (JP) ..... 2005-308333

(51) Int. Cl.
*F02M 37/04* (2006.01)

(52) U.S. Cl. ..... 123/506

(58) Field of Classification Search ..... 310/34; 417/417; 123/450, 506, 505, 495, 24 R, 123/198 D, 500; 701/103; *F02M 37/04*
See application file for complete search history.

(56) References Cited

U.S. PATENT DOCUMENTS 1,640,742 A * 8/1927 Wallace et al. ..... 310/34
6,631,706 B1 10/2003 Yamada et al.
7,255,290 B2 * 8/2007 Bright et al. ..... 239/102.2
2003/0164161 A1 9/2003 Usui et al.
2004/0055580 A1 3/2004 Yamada et al.

FOREIGN PATENT DOCUMENTS

JP 2001-295720 10/2001
JP 2003-113759 4/2003

OTHER PUBLICATIONS

Office Action in the Corresponding CN Application No. 200610075146.8 dated Oct. 12, 2007 and English translation thereof.
Chinese Office Action dated Mar. 6, 2009, issued in corresponding Chinese Application No. 200610075146.8, with English translation.
Japanese Office Action dated Oct. 8, 2009, issued in corresponding Japanese Application No. 2005-308333, with English translation.

* cited by examiner

*Primary Examiner*—Stephen K Cronin
*Assistant Examiner*—Keith Coleman
(74) *Attorney, Agent, or Firm*—Nixon & Vanderhye PC

(57) ABSTRACT

A pump includes a housing that has a compression chamber for pressurizing fluid and a fluid passage for guiding fluid into the compression chamber. A valve is located midway through the fluid passage for communicating and blocking the fluid passage. A solenoid actuator is located on a substantially opposite side of the compression chamber with respect to the valve for operating the valve. A regulating member is located between the valve and the solenoid actuator for regulating pressure of fluid in the compression chamber from being applied to the solenoid actuator.

1 Claim, 16 Drawing Sheets

HIGH PRESSURE PUMP HAVING SOLENOID ACTUATOR

CROSS REFERENCE TO RELATED APPLICATIONS

This application is based on and incorporates herein by reference Japanese Patent Applications No. 2005-127743 filed on Apr. 26, 2005 and No. 2005-308333 filed on Oct. 24, 2005.

FIELD OF THE INVENTION

The present invention relates to a high pressure pump having a solenoid actuator, the pump being adapted to pressurizing fuel in a compression chamber.

BACKGROUND OF THE INVENTION

According to JP-A-2001-295720 and U.S. Pat. No. 6,631,706B1, US2004/0055580A1 (WO00/47888), high pressure fuel pumps are disclosed. In general, a high pressure fuel pump pressurizes fuel drawn into a compression chamber, and discharges the fuel by an axial movement of a plunger. For example, the fuel discharged from the high pressure fuel pump is distributed to an injector provided to each cylinder of an engine via a delivery pipe. The high pressure fuel pump includes a metering valve for controlling an amount of the fuel discharged flowing from the compression chamber, in general. The metering valve is arranged in an inlet of the compression chamber.

In the structure of the high pressure fuel pump disclosed in JP-A-2001-295720, a valve body and an electromagnetic driving portion (solenoid actuator) are integrally constructed in the metering valve. The solenoid actuator operates the valve body, which faces the compression chamber. Therefore, when pressure of fuel in the compression chamber increases, pressure of the fuel is applied to the solenoid actuator integrated with the valve body. In this structure, the rigidity of the solenoid actuator needs to be enhanced such that the solenoid actuator is capable of resisting pressure of the fuel repeatedly applied.

Furthermore, in the structure of the high pressure fuel pump disclosed in U.S. Pat. No. 6,631,706B1 and US2004/0055580A1, the valve body and the solenoid actuator are separately constructed in the electromagnetic valve (solenoid valve). The valve body separated from the solenoid actuator is interposed between the solenoid actuator and a housing defining the compression chamber. However, hydraulic pressure in the compression chamber is applied to a guide member, which guides the movement of the valve body, provided to the solenoid actuator. Therefore, the hydraulic pressure in the compression chamber is applied to the solenoid actuator via the guide member. As a result, the solenoid actuator needs to be firmly fixed to the housing, and the rigidity of the solenoid actuator needs to be enhanced to prevent deformation when the solenoid actuator is fixed to the housing.

In the above structures, the rigidities of both the solenoid valve and the solenoid actuator constructing the solenoid valve need to be enhanced. Therefore, the solenoid valve may become structurally complicated. In addition, the solenoid valve may become jumboized.

SUMMARY OF THE INVENTION

In view of the foregoing and other problems, it is an object of the present invention to produce a high pressure pump, in which hydraulic pressure applied to the solenoid actuator can be reduced.

According to one aspect of the present invention, a pump includes a housing, a valve, a solenoid actuator, and a regulating member. The housing has a compression chamber for pressurizing fluid. The housing further has a fluid passage for guiding fluid into the compression chamber. The valve is located midway through the fluid passage. The valve is adapted to communicating the fluid passage. The valve is adapted to blocking the fluid passage. The solenoid actuator is located on a substantially opposite side of the compression chamber with respect to the valve. The solenoid actuator is adapted to operating the valve. The regulating member is located between the valve and the solenoid actuator for regulating pressure of fluid in the compression chamber from being applied to the solenoid actuator.

In this structure, the solenoid actuator can be restricted from being applied with pressure from the compression chamber. Therefore, rigidity of the solenoid actuator need not be enhanced, so that the solenoid actuator can be downsized.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
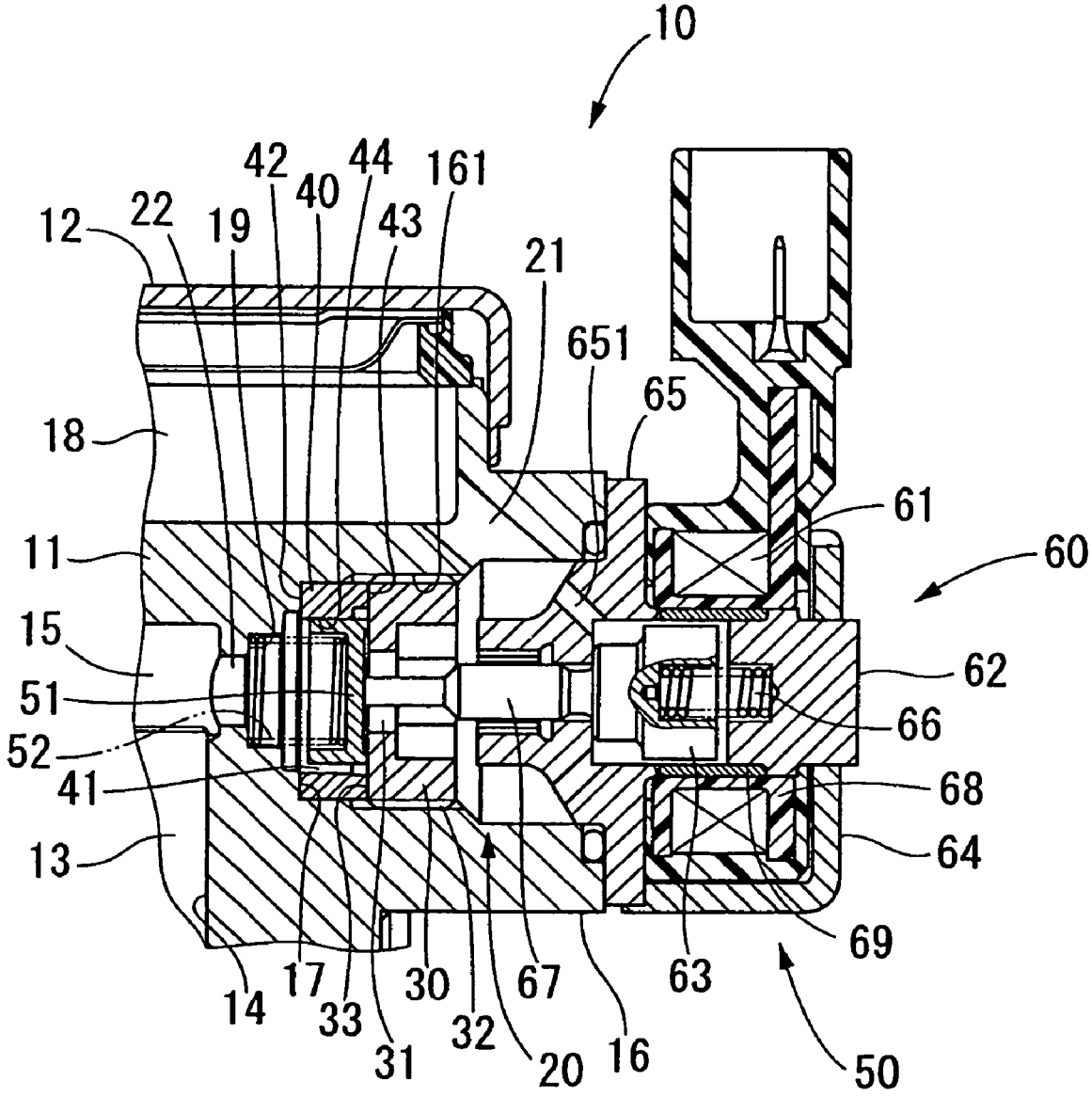
FIG. 1 is a partially cross-sectional side view showing a metering valve of a high pressure fuel pump in accordance with a first embodiment of the present invention.
Figure 2:
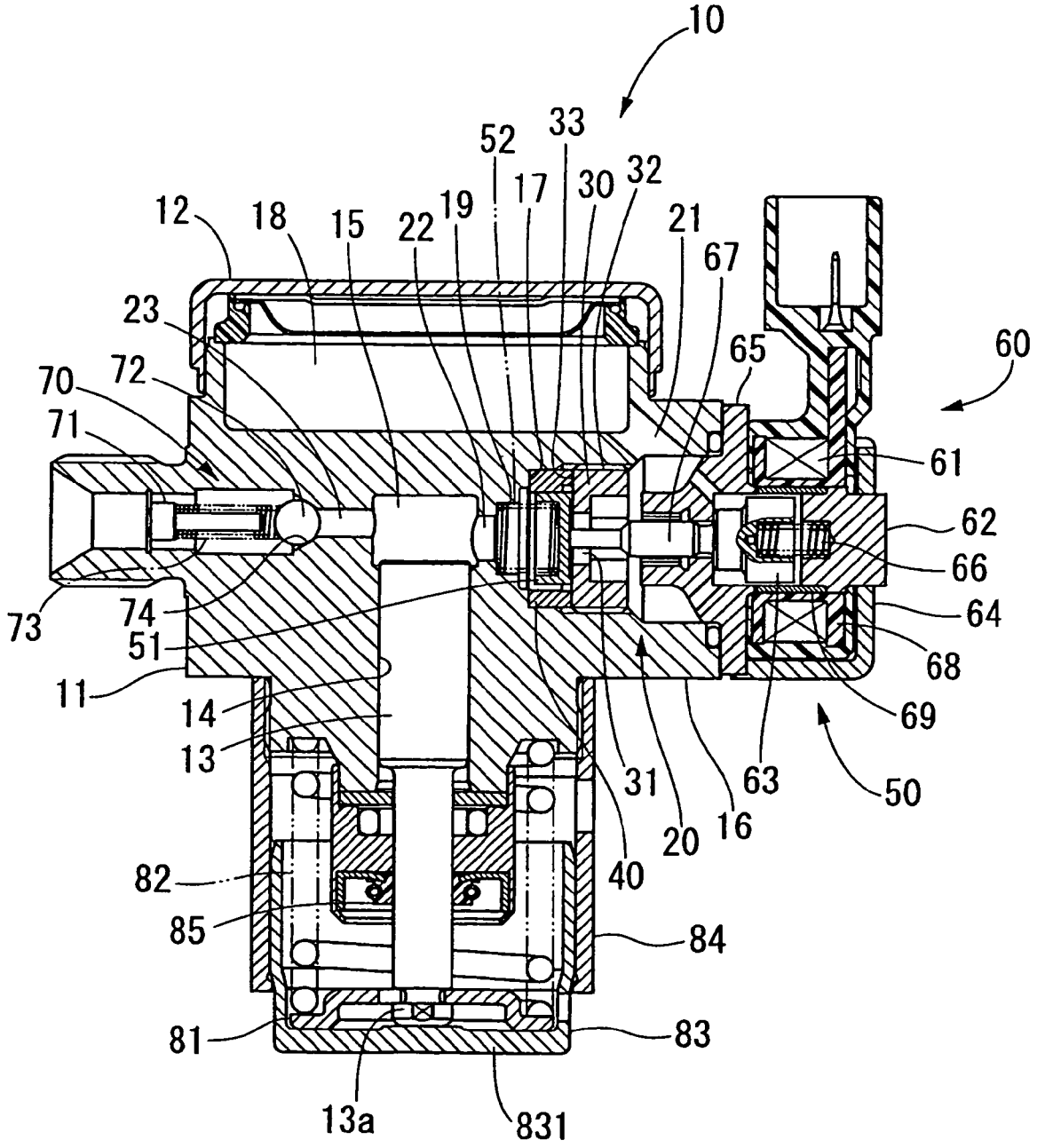
FIG. 2 is a partially cross-sectional side view schematically showing the high pressure fuel pump in accordance with the first embodiment.

A high pressure fuel pump 10 of the first embodiment is described in reference to FIGS. 1, 2. This high pressure fuel pump 10 is a fuel pump for supplying fuel into an injector of a diesel engine and a gasoline engine, for example.

The high pressure fuel pump 10 has a housing main body 11, a cover 12, a plunger 13, a metering valve portion 50, a delivery valve portion 70, and the like. The housing main body 11 and the cover 12 construct a housing. The housing main body 11 is formed of martensitic stainless steel, or the like. The housing main body 11 has a cylinder 14, which is in a substantially cylindrical shape. The plunger 13 is movable with respect to a substantially axial direction of the plunger 13 in the cylinder 14 of the housing main body 11.

The housing main body 11 has an introducing passage 21, an inlet passage 22, a compression chamber 15, a delivery passage 23, and the like. The housing main body 11 has a cylindrical portion 16. The cylindrical portion 16 internally forms a through hole portion 20 for communicating the introducing passage 21 with the inlet passage 22. The cylindrical portion 16 is approximately perpendicularly to the cylinder 14. The cylindrical portion 16 has the inner diameter, which changes midway through the cylindrical portion 16. The housing main body 11 has a step face 17 in a portion, in which the inner diameter changes in the cylindrical portion 16. A seat member 30 and a guide member 40 are provided in the cylindrical portion 16.

A fuel chamber 18 is formed between the housing main body 11 and the cover 12. The introducing passage 21 communicates the fuel chamber 18 with the through hole portion 20, which is formed inside the inner circumferential periphery of the cylindrical portion 16. One end portion of the inlet passage 22 communicates with the compression chamber 15. The other end portion of the inlet passage 22 opens to the inner circumferential side of the step face 17, and communicates with the through hole portion 20. As shown in FIG. 1, the introducing passage 21 and the inlet passage 22 communicate with each other via a through hole 31 and a groove 41. The through hole 31 is located in the inner circumferential side of the seat member 30. The groove 41 is formed in a guide member 40. In this structure, the fuel chamber 18 and the compression chamber 15 is capable of communicating with each other through the introducing passage 21, the through hole portion 20 of the housing main body 11, the through hole 31 of the seat member 30, the groove 41 of the guide member 40, and the inlet passage 22. The introducing passage 21, the through hole portion 20, the through hole 31, the groove 41, and the inlet passage 22 construct a fuel passage. This fuel passage communicates the fuel chamber 18 with the compression chamber 15. As referred to FIG. 2, the compression chamber 15 communicates with the delivery passage 23 on the opposite side of the inlet passage 22.

The plunger 13 is supported in the cylinder 14 of the housing main body 11 so as to be movable in a substantially axial direction of the plunger 13. The compression chamber 15 is formed on one end side with respect to a movable direction of the plunger 13. A head 13*a* formed on the other end side of the plunger 13 is connected with a spring seat 81. A spring 82 is arranged between the spring seat 81 and the housing main body 11. The spring seat 81 is pressed against the inner wall of a bottom portion 831 of a tappet 83 by resiliency of the spring 82. The outer wall of the bottom portion 831 of the tappet 83 makes contact with an unillustrated cam, so that the plunger 13 is reciprocated in a substantially axial direction of the plunger 13. A movement of the tappet 83 is guided by a tappet guide 84. The tappet guide 84 is attached to the outer circumferential side of the cylinder 14 of the housing main body 11.

An outer circumferential face of the head 13*a* of the plunger 13 is sealed with respect to an inner circumferential face of the housing main body 11 having the cylinder 14 accommodating the plunger 13 via an oil seal 85. The oil seal 85 restricts intrusion of oil from the interior of the engine into the compression chamber 15. The oil seal 85 also restricts leakage of the fuel from the compression chamber 15 to the engine.

The delivery valve portion 70 having a fuel outlet is arranged in the delivery passage 23 of the housing main body 11. The delivery valve portion 70 performs and terminates discharge of the fuel pressurized in the compression chamber 15. The delivery valve portion 70 has a valve shaft member 71, a ball member (ball plug) 72, and a spring 73. The valve shaft member 71 is fixed to the housing main body 11 having the delivery passage 23. One end portion of the spring 73 makes contact with the valve shaft member 71, and the other end portion of the spring 73 makes contact with the ball plug 72. The ball plug 72 is pressed onto the a valve seat 74 defined on the housing main body 11, by resiliency of the spring 73. The ball plug 72 blocks the delivery passage 23 by setting the ball plug 72 to seat on the valve seat 74, and communicates the delivery passage 23 by lifting the ball plug 72 from the valve seat 74. When the ball plug 72 is moved to the opposed side of the valve seat 74, the ball plug 72 makes contact with an end portion of the valve shaft member 71, so that the lift of the ball plug 72 is limited. When pressure of fuel in the compression chamber 15 increases, force applied to the ball plug 72 from the compression chamber 15 increases. The ball plug 72 is lifted from the valve seat 74 when the force applied to the ball plug 72 from the compression chamber 15 becomes greater than a sum of the resiliency of the spring 73 and the force applied to the ball plug 72 from the downstream of the valve seat 74. Specifically, the ball plug 72 is applied with force from fuel in a delivery pipe (not shown) in the downstream of the valve seat 74. By contrast, when pressure of fuel in the compression chamber 15 decreases, the force applied to the ball plug 72 from the compression chamber 15 decreases. The ball plug 72 is seated on the valve seat 74 when the force applied to the ball plug 72 from the compression chamber 15 becomes less than the sum of the resiliency of the spring 73 and the force applied to the ball plug 72 from fuel in the delivery pipe on the downstream side of the valve seat 74. Thus, the delivery valve portion 70 serves as a check valve for performing and terminating the discharge of fuel from the compression chamber 15.

As referred to FIG. 1, the guide member 40 is interposed between the housing main body 11 and the seat member 30. The guide member 40 has a first seal face 42 in one end portion of this guide member 40 with respect to the axial direction. The first seal face 42 makes contact closely with the step face 17 of the housing main body 11. The seat member 30 has a male screw portion 32 on the outer circumferential periphery thereof. The male screw portion 32 of the seat member 30 is screwed into a female screw portion 161 formed in the inner circumferential periphery of the cylindrical portion 16. Thus, the seat member 30 is fixed to the housing main body 11 by this screw connection, and the guide member 40 is interposed and supported between this seat member 30 and the housing main body 11. The guide member 40 has a second seal face 43 on an end portion thereof on the opposite side of the first seal face 42 with respect to the guide member 40. The second seal face 43 of the guide member 40 makes contact closely with a seat face 33 formed on an end portion of the seat member 30 by screw-connecting the seat member 30 into the housing main body 11.

The metering valve portion 50 has a valve member (valve) 51, a spring 52 and an electromagnetic driving portion (solenoid actuator) 60. The plug 51 is arranged inside the inner circumferential periphery of the guide member 40 so as to be movable in the axial direction of the plug 51. The plug 51 is formed approximately in an annular shape. The spring 52 is arranged on the opposite side of the seat member 30 with respect to the plug 51. One end portion of the spring 52 makes contact with a wall face 19 of the housing main body 11, and the other end portion of the spring 52 makes contact with the plug 51. The plug 51 is pressed onto the seat member 30 by the spring 52. The plug 51 has an end portion, which is on the side of the seat member 30, adapted to be seated on the seat face 33. The compression chamber 15 and the fuel chamber 18 have a fuel passage therebetween. This fuel passage is blocked by seating the plug 51 on the seat face 33. The plug 51 has the outer circumferential face that is slidable on a guide face 44 of the guide member 40. Thus, an axial movement of the plug 51 is guided by the guide face 44 of the guide member 40. Further, the guide member 40 has the groove 41 in the inner circumferential periphery thereof. Thus, when the plug 51 is lifted from the seat member 30, fuel in the through hole 31 of the seat member 30 flows into the inlet passage 22 through the groove 41.

The solenoid actuator 60 has a coil 61, a fixed core 62, a movable core 63, a magnetic member 64, a flange 65, a spring 66 and a needle 67. The coil 61 is wound around a resin member 68, so that a magnetic field is generated by conducting electric current to the coil 61. The fixed core 62 is formed of a magnetic material. The fixed core 62 is accommodated inside the inner circumferential peripheries of the coil 61 and the magnetic member 64. The movable core 63 is formed of a magnetic material. The movable core 63 is opposed to the fixed core 62. The movable core 63 is accommodated inside the inner circumferential periphery of a sleeve member 69 formed of a non-magnetic material. The movable core 63 is movable with respect to the axial direction thereof. The sleeve member 69 accommodates the movable core 63, thereby restricting a magnetic short circuit between the fixed core 62 and the flange 65. The spring 66 is arranged between the fixed core 62 and the movable core 63. The spring 66 presses the movable core 63 to the opposite side of the fixed core 62. Thus, when electric current is not conducted to the coil 61, the fixed core 62 and the movable core 63 are separated from each other.

The flange 65 is formed of a magnetic material. The flange 65 is attached to the cylindrical portion 16 of the housing main body 11. Thus, the flange 65 fixes the solenoid actuator 60 to the housing main body 11, and blocks an end portion of the cylindrical portion 16. The magnetic member 64 covers the outer circumferential periphery of the coil 61. The magnetic member 64 is formed of a magnetic material. The magnetic member 64 connects the fixed core 62 magnetically with the flange 65. The flange 65 has a through hole 651. In this structure, the inner circumferential side of the flange 65 and the outer circumferential side of the flange 65 are maintained at the same pressure.

The movable core 63 is assembled integrally with the needle 67. The needle 67 has an end portion, which is on the opposite side of the movable core 63, adapted to making contact with the plug 51. Resiliency of the spring 66 is greater than resiliency of the spring 52. Therefore, when electric current is not conducted to the coil 61, the needle 67 integrated with the movable core 63 is moved to the plug 51 by the resiliency of the spring 66, so that the plug 51 is lifted from the seat member 30.

The operation of the high pressure fuel pump 10 of the above construction is described as follows.

As follows, an intake stroke is described.

When the plunger 13 is moved downward in FIG. 2, the conduction of the electric current to the coil 61 is terminated. Therefore, the plug 51 is pressed to the compression chamber 15 by the needle 67 integrated with the movable core 63 pressed using the spring 66. As a result, the plug 51 is lifted from the seat member 30. Further, when the plunger 13 is moved downward in FIG. 2, pressure in the compression chamber 15 decreases. Therefore, force applied to the plug 51 from the through hole 31 becomes greater than force applied to the plug 51 from the compression chamber 15. Therefore, lifting force is applied to the plug 51 such that the plug 51 is lifted from the seat face 33, so that the plug 51 is lifted from the seat face 33. Thus, fuel chamber 18 communicates with the compression chamber 15 through the introducing passage 21, the through hole portion 20, the through hole 31, the groove 41 and the inlet passage 22. Thus, fuel in fuel chamber 18 is drawn into the compression chamber 15.

As follows, a return stroke is described.

When the plunger 13 upwardly moves from the bottom dead center to the top dead center, pressure of fuel in the compression chamber 15 increases, so that force is applied from the compression chamber 15 to the plug 51 such that the plug 51 is seated onto the seat face 33. However, when electric current is not conducted to the coil 61, the needle 67 is projected to the compression chamber 15 from the seat face 33 by the resiliency of the spring 66. Therefore, the movement of the plug 51 with respect to the seat face 33 is regulated by the needle 67. Consequently, while the electric current conduction to the coil 61 is terminated, the plug 51 maintains a state, in which the plug 51 is lifted from the seat face 33. Thus, reversely to a condition, in which fuel is drawn from fuel chamber 18 into the compression chamber 15, fuel in the compression chamber 15 pressurized by upwardly moving the plunger 13 is returned to fuel chamber 18 through the inlet passage 22, the groove 41, the through hole 31, the through hole portion 20 and the introducing passage 21.

As follows, a compression stroke is described.

When electric current is conducted through the coil 61 during the return stroke, a magnetic circuit is formed in the fixed core 62, the magnetic member 64, the flange 65 and the movable core 63 by a magnetic field generated in the coil 61. Thus, magnetic attractive force is generated between the fixed core 62 and the movable core 63, which are separated from each other. When the magnetic attractive force generated between the fixed core 62 and the movable core 63 becomes greater than the resiliency of the spring 66, the movable core 63 is moved to the fixed core 62. Therefore, the needle 67 integrated with the movable core 63 is also moved to the fixed core 62. When the needle 67 is moved to the fixed core 62, the plug 51 and the needle 67 are separated from each other, so that the plug 51 is released from the force applied from the needle 67. Consequently, the plug 51 is moved onto the seat face 33 by the resiliency of the spring 52 and force applied from the compression chamber 15. The spring 52 serves as a bias member.

The plug 51 is moved to the seat face 33 and is seated onto the seat face 33, so that the inlet passage 22 is blocked from the through hole 31. Thus, the returning fuel from the compression chamber 15 to fuel chamber 18 is terminated. The amount of fuel returned from the compression chamber 15 to fuel chamber 18 is adjusted in the upward movement of the plunger 13 by blocking the compression chamber 15 from fuel chamber 18. Thus, the amount of fuel pressurized in the compression chamber 15 is controlled.

As the plunger 13 upwardly moves further to the top dead center in this blocking state of the compression chamber 15 from fuel chamber 18, pressure of fuel in the compression chamber 15 increases. When pressure of fuel in the compression chamber 15 becomes a predetermined pressure or greater, the ball plug 72 is lifted from the valve seat 74 against the resiliency of the spring 73 in the delivery valve portion 70 and force applied to the ball plug 72 from the delivery pipe in the downstream of the valve seat 74. Thus, the delivery valve portion 70 opens, so that fuel pressurized in the compression chamber 15 is discharged from the high pressure fuel pump 10 through the delivery passage 23. Fuel discharged from the high pressure fuel pump 10 is supplied to the delivery pipe, and is accumulated in a fuel accumulator (not shown), thereby being supplied to an injector (not shown). In this condition, the needle 67 is lifted from the plug 51. Therefore, even when force is applied from the compression chamber 15 to the plug 51, this force applied to the plug 51 can be restricted from being transmitted to the needle 67 of the solenoid actuator 60.

The plunger 13 moves downwardly in FIG. 2 again, after reaching the top dead center, so that pressure of fuel in the compression chamber 15 decreases. In this condition, the electric current conduction to the coil 61 is terminated. Therefore, the plug 51 is lifted from the seat face 33 again, and fuel is drawn from fuel chamber 18 into the compression chamber 15. The electric current conduction to the coil 61 may be also terminated in a condition where pressure of fuel in the compression chamber 15 increases to predetermined pressure.

Force is applied to the plug 51 by fuel in the compression chamber 15 in a seating direction, in which the plug 51 is seated on the seat face 33. In addition, force is applied to the plug 51 in a lifting direction, in which the plug 51 is lifted from the seat face 33. As pressure of fuel in the compression chamber 15 increases, force applied to the plug 51 in the seating direction becomes greater than force applied to the plug 51 in the lifting direction. Therefore, even when the electric current conduction to the coil 61 is terminated, the plug 51 maintains the seating state, in which the plug 51 is seated onto the seat face 33 of the seat member 30 by the force applied from the compression chamber 15. Thus, electric power consumption of the solenoid actuator 60 can be reduced by stopping the electric current conduction to the coil 61 in a predetermined period. The high pressure fuel pump 10 pressurizes the drawn fuel, and discharges the pressurized fuel by repeating the above strokes including the intake stroke to the compression stroke. The discharge amount of fuel is adjusted by controlling the timing and the period, in which electric current is conducted to the coil 61 of the metering valve portion 50.

In this first embodiment, the seat member 30 is screwed into the cylindrical portion 16 of the housing main body 11, so that the guide member 40 is interposed by the seat member 30 between the seat member 30 and the housing main body 11. Thus, the first seal face 42 makes contact closely with the step face 17 of the housing main body 11, and the second seal face 43 of the guide member 40 makes contact closely with the seat face 33 of the seat member 30. The step face 17 and the first seal face 42 make contact closely with reach other. In addition, the second seal face 43 and the seat face 33 make contact closely with reach other. In this structure, fuel increasing in pressure corresponding to the pressurization in the compression chamber 15 is sealed by the metal seal structure formed between the step face 17 and the first seal face 42, and the metal seal structure formed between the second seal face 43 and the seat face 33. Therefore, fuel increasing in pressure in the compression chamber 15 can be restricted from intruding into the solenoid actuator 60 by forming the metal seal structure. Further, when the electric current is conducted through the coil 61, the needle 67 is lifted from the plug 51. Consequently, force is not applied to the solenoid actuator 60 from the high pressure fuel in the compression chamber 15. Accordingly, the rigidity of the solenoid actuator 60 need not be enhanced. In addition, the physical structure of the solenoid actuator 60 can be restricted from being jumboized.

In the above structure, the fuel chamber 18 and the compression chamber 15 in the housing main body 11 have a regulating structure constructed of a regulating member. The regulating member regulates pressure of fuel pressurized in the compression chamber 15 from being applied to the side of the solenoid actuator 60. Thus, hydraulic pressure applied from the compression chamber 15 to the solenoid actuator 60 can be reduced in the simple structure thereof. Therefore, the rigidity of the solenoid actuator 60 need not be enhanced, and the physical structure of the solenoid actuator 60 need not be jumboized. Accordingly, the hydraulic pressure applied to the solenoid actuator 60 can be reduced in the simple structure, while restricting the solenoid actuator 60 from being jumboized.

In the above structure, the seat member 30 is fixed between the fuel chamber 18 and the compression chamber 15 in the housing main body 11. The seat member 30 has the seal face 43 making contact closely with the step face 17 of the housing main body 11. The step face 17 makes contact closely with the seal face 43, so that fuel in the compression chamber 15 can be restricted from entering the solenoid actuator 60 by the close step face 17 and seal face 43. Thus, the hydraulic pressure applied from the compression chamber 15 to the solenoid actuator 60 can be reduced without causing complicatedness of the structure. Therefore, the rigidity of the solenoid actuator 60 need not be enhanced, and the physical structure of the solenoid actuator 60 need not be jumboized. Accordingly, the hydraulic pressure applied to the solenoid actuator 60 can be reduced by the simple structure, while restricting the solenoid actuator 60 from being jumboized.

In the above structure, the guide member 40 for guiding the movement of the plug 51 is arranged between the housing main body 11 and the seat member 30. The guide member 40 respectively makes contact closely with the step face 17 of the housing main body 11 and the seat face 33 of the seat member 30 with respect to a substantially axial end portion. Therefore, fuel in the compression chamber 15 can be restricted from entering the solenoid actuator 60 by the seal structure between the step face 17 and the first seal face 42, and the seal structure between the seat face 33 and the second seal face 43 mutually closely making contact with each other. Thus, the hydraulic pressure applied from the compression chamber 15 to the solenoid actuator 60 can be reduced without causing complicatedness of the structure thereof. Consequently, the rigidity of the solenoid actuator 60 need not be enhanced, and the physical structure of the solenoid actuator 60 need not be jumboized. Accordingly, the hydraulic pressure applied to the solenoid actuator 60 can be reduced by the simple structure, while restricting the solenoid actuator 60 from being jumboized.

In the above structure, the solenoid actuator 60 includes the needle 67 and the coil 61. The needle 67 presses the plug 51 to the side of the compression chamber 15. When the fuel is pressurized in the compression chamber 15, the needle 67 is attracted to the opposite side of the compression chamber 15, and the plug 51 blocks the fuel passage by pressure of fuel in the compression chamber 15. Therefore, it is not necessary to set the plug 51 and the needle 67 to come in contact with each other. Thus, even when pressure of the fuel is applied to the plug 51, pressure of the fuel can be restricted from being applied to the solenoid actuator 60 including the needle 67, so that the pressure of the fuel can be restricted from being applied to the solenoid actuator 60. Accordingly, the hydraulic pressure applied to the solenoid actuator 60 can be reduced.

Second Embodiment

Figure 3:
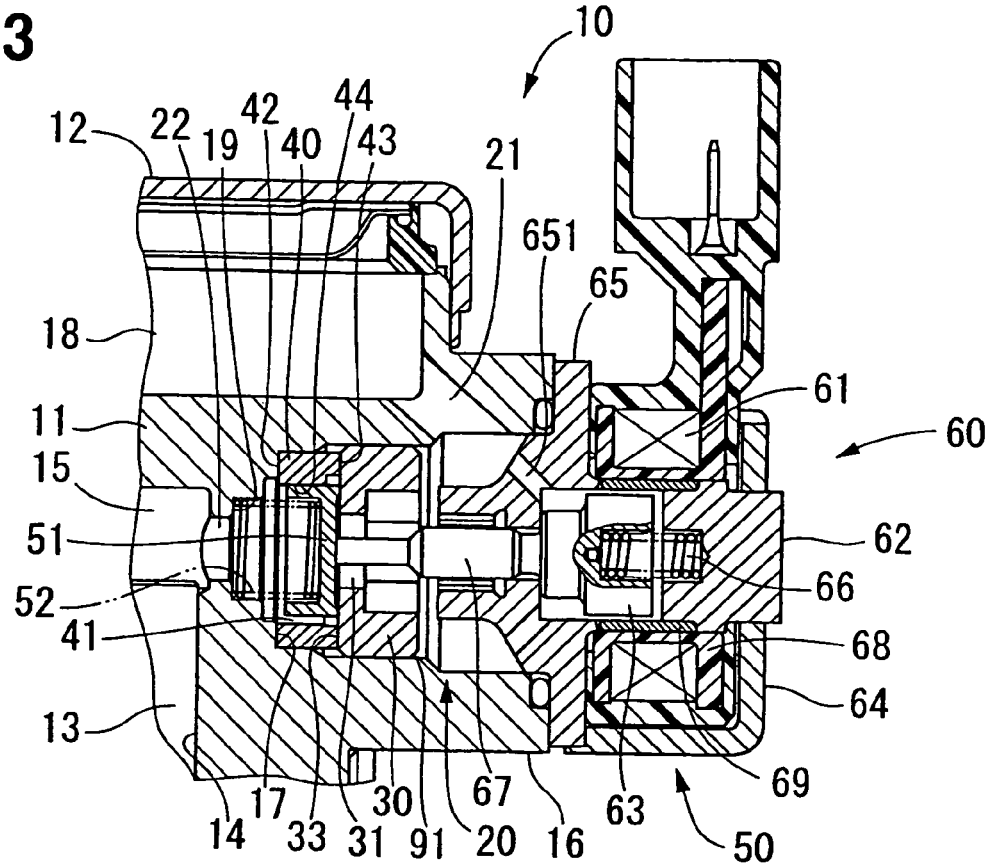
FIG. 3 is a partially cross-sectional side view showing a metering valve of a high pressure fuel pump, in accordance with a second embodiment of the present invention.

In the second embodiment shown in FIG. 3, the seat member 30 is press-fitted into the inner circumferential periphery of the cylindrical portion 16. Namely, the inner diameter of the cylindrical portion 16 is formed to be approximately equal to or slightly less than the outer diameter of the seat member 30. Thus, the seat member 30 is fixed to the inner circumferential periphery of the cylindrical portion 16, so that the guide member 40 is interposed between the seat member 30 and the housing main body 11.

In this second embodiment, the seat member 30 is welded to the housing main body 11 in a weld portion 91 formed in an end portion thereof on the opposite side of the guide member 40. When the seat member 30 is press-fitted into the cylindrical portion 16, the high pressure fuel pressurized in the compression chamber 15 mat be leaked into the solenoid actuator 60 through the portion between the inner circumferential face of the cylindrical portion 16 and the outer circumferential face of the seat member 30. In this structure, intrusion of fuel into the solenoid actuator 60 can be reduced by welding the seat member 30 with the housing main body 11 in the weld portion 91.

In this structure of the second embodiment, the seat member 30 is press-fitted into the housing main body 11. Thus, the seat face 33 of the seat member 30 makes contact closely with the step face 17 of the housing main body 11 by large force. Therefore, fuel in the compression chamber 15 can be restricted from entering the solenoid actuator 60. Accordingly, the hydraulic pressure applied to the solenoid actuator 60 can be reduced.

Furthermore, in this structure of the second embodiment, the seat member 30 is welded to the housing main body 11 in the end portion thereof on the side of the fuel chamber 18, so that the relative movement of the seat member 30 with respect to the housing main body 11 can be further regulated. Therefore, even when pressure of the fuel is repeatedly applied from the compression chamber 15 to the seat member 30, the seat member 30 is firmly fixed to the housing main body 11. Accordingly, the hydraulic pressure applied to the solenoid actuator 60 can be further reduced.

Third and Fourth Embodiments

Figure 4:
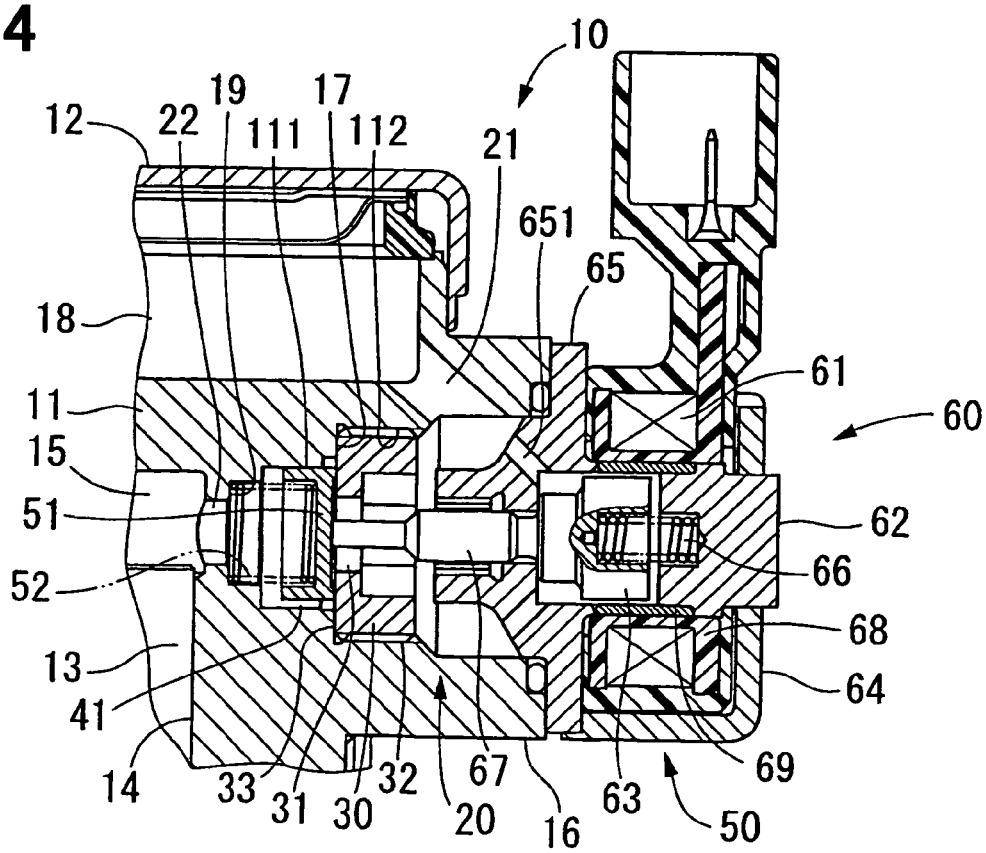
FIG. 4 is a partially cross-sectional side view showing a metering valve of a high pressure fuel pump, in accordance with a third embodiment of the present invention.

In the third embodiment, as shown in FIG. 4, the guide member is omitted from the structures of those in the first and second embodiments. In addition, a guide face 111 is formed in the housing main body 11. Namely, the housing main body 11 has the guide face 111 for guiding the movement of the plug 51. The inner circumferential face of the housing main body 11 defining the guide face 111 is slid on the outer circumferential face of the plug 51, thereby guiding the movement of the plug 51. The inner diameter of the guide face 111 of the housing main body 11 is less than the inner diameter of the cylindrical portion 16 accommodating the seat member 30. Therefore, the step face 17 is formed between the guide face 111 and the cylindrical portion 16.

A female screw portion 112 is formed in the inner circumferential periphery of the cylindrical portion 16. The female screw portion 112 is screwed to the male screw portion 32 of the seat member 30. The seat face 33 of the seat member 30 makes contact closely with the step face 17 of the housing main body 11 by screwing the seat member 30 into the inner circumferential periphery of the cylindrical portion 16. Thus, a metal seal structure is formed between the step face 17 of the housing main body 11 and the seat face 33 of the seat member 30.

In the above structure of the third embodiment, the seat member 30 is fixed to the housing main body 11 by the screw connection. Thus, the seat face 33 of the seat member 30 makes contact closely with the step face 17 of the housing main body 11 by large force. Therefore, fuel in the compression chamber 15 can be restricted from entering the solenoid actuator 60. Accordingly, the hydraulic pressure applied to the solenoid actuator 60 can be reduced.

Figure 5:
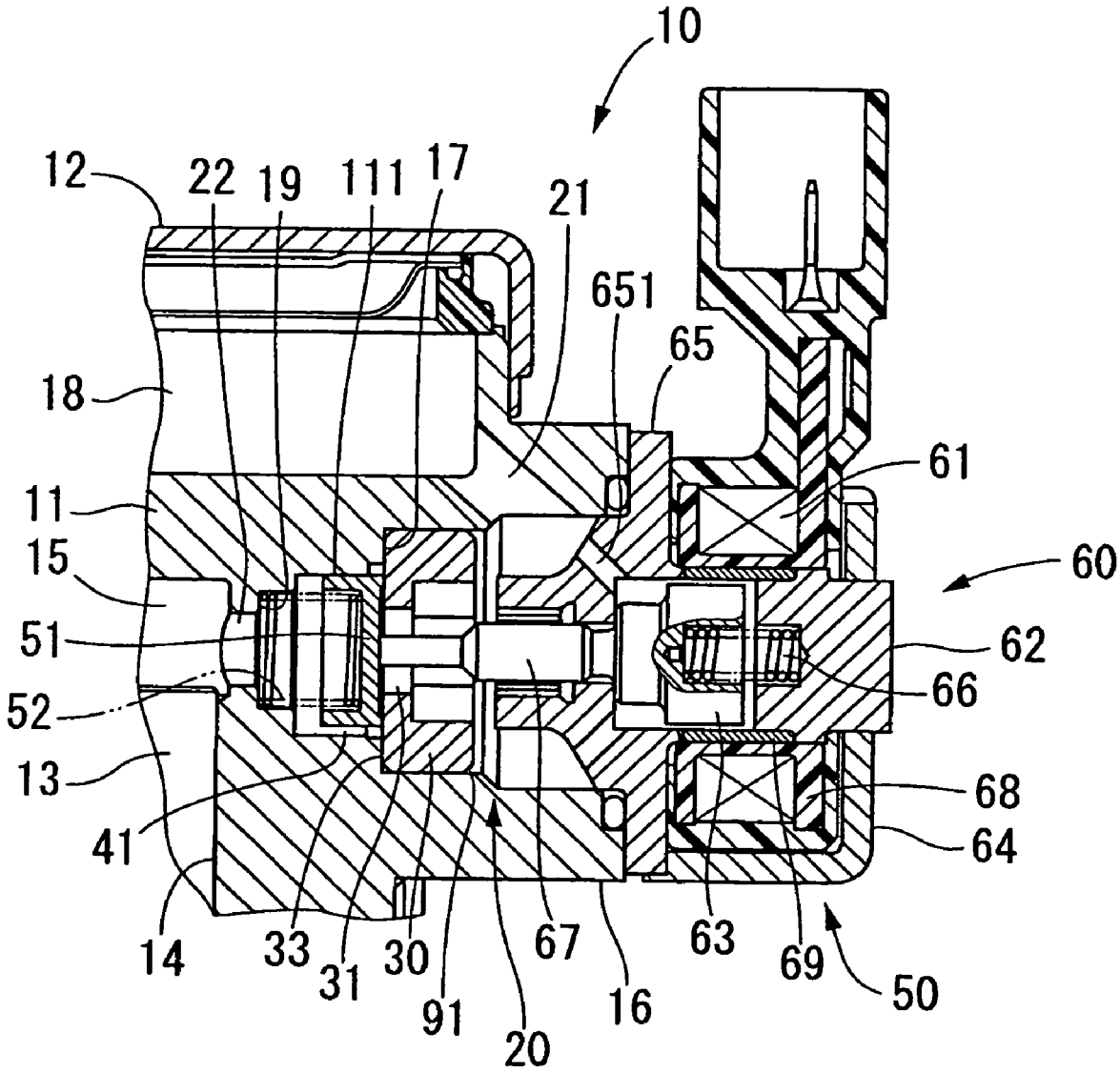
FIG. 5 is a partially cross-sectional side view showing a metering valve of a high pressure fuel pump, in accordance with a fourth embodiment of the present invention.

In the fourth embodiment, as shown in FIG. 5, similarly to the third embodiment, the guide member is omitted. In addition, similarly to the second embodiment, the seat member 30 is press-fitted into the inner circumferential side of the cylindrical portion 16, and is welded to the housing main body 11 in the weld portion 91 of an end portion on the opposite side of the plug 51.

In the third and fourth embodiments, the guide member is omitted. Therefore, the high pressure fuel can be restricted from intruding from the compression chamber 15 into the solenoid actuator 60. In addition, the number of components can be reduced.

Fifth, Sixth, and Seventh Embodiments

Figure 6:
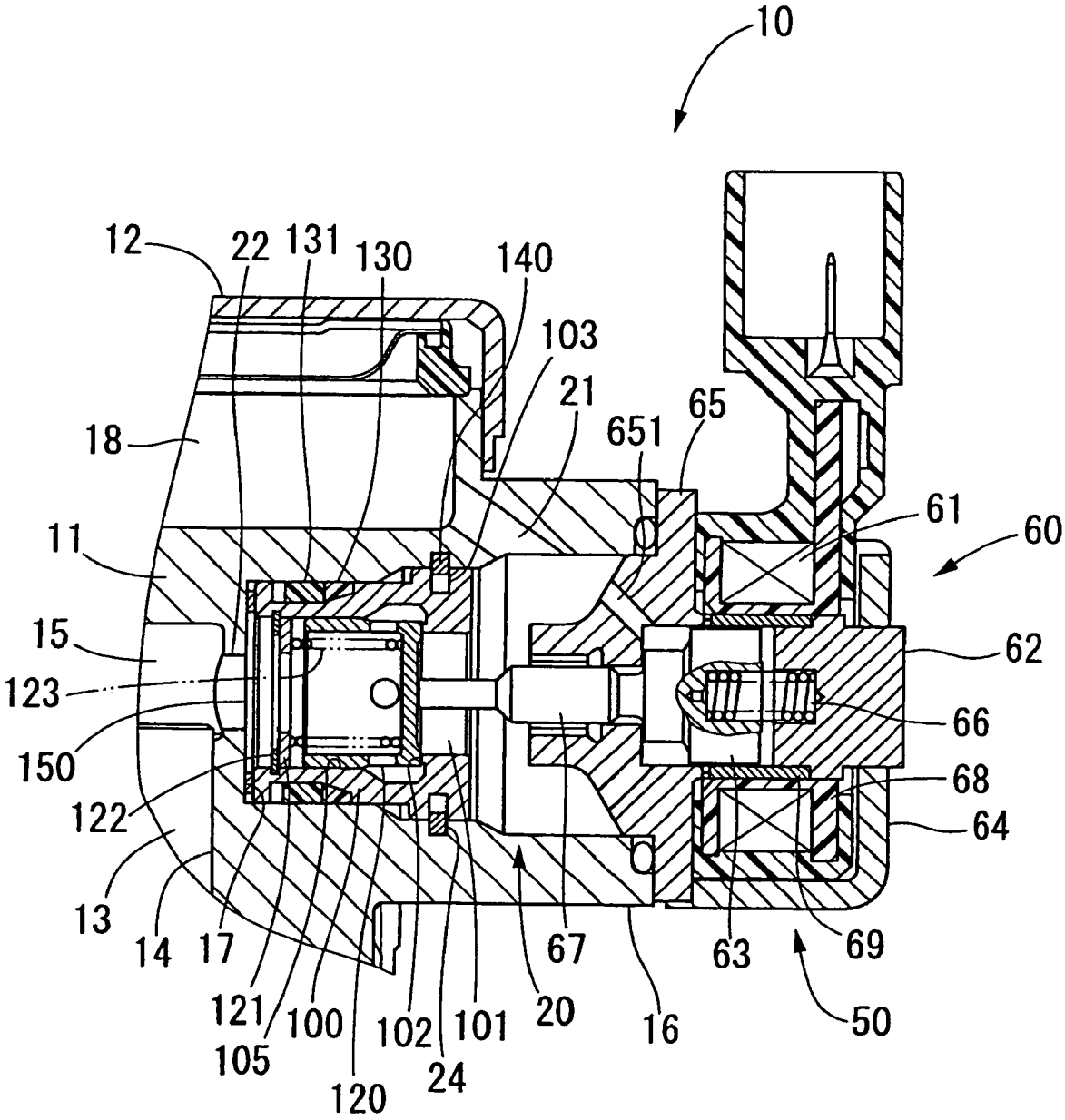
FIG. 6 is a partially cross-sectional side view showing a metering valve of a high pressure fuel pump, in accordance with a fifth embodiment of the present invention.

In the fifth embodiment, as shown in FIG. 6, a valve body 100 is accommodated inside the inner circumferential periphery of the cylindrical portion 16 of the housing main body 11. A valve body 100 is formed in a substantially cylindrical shape. The valve body 100 has the inner circumferential periphery that defines a through hole 101 for communicating the introducing passage 21 with the inlet passage 22. A plug 120 is accommodated inside the inner circumferential periphery of the housing main body 11. The plug 120 is movable in a substantially axial direction thereof. The plug 120 is adapted to seated on a seat face 102 formed on the valve body 100. When the plug 120 is lifted from the seat face 102, fuel is permitted to flow between the introducing passage 21 and the inlet passage 22. By contrast, when the plug 120 is seated on the seat face 102, the flow of the fuel between the introducing passage 21 and the inlet passage 22 is interrupted.

A spring seat 121 is provided in the valve body 100. The spring seat 121 is held in the valve body 100 by an engaging member 122. The engaging member 122 is fitted into a groove formed in an inner circumferential wall of the valve body 100, so that the engaging member 122 is fixed to the valve body 100. One end of a spring 123, which serves as a bias member, makes contact with the spring seat 121. The other end of the spring 123 makes contact with the plug 120. The spring 123 produces resilient force, such that the sprig 123 extends in the axial direction thereof. Thus, the plug 120 is pressed in a direction, in which the plug 120 is seated on the seat face 102 of the valve body 100. The plug 120 is guided along a guide face 105 defined by the inner circumferential face of the valve body 100, thereby being movable with respect to the axial direction thereof.

Seal members 130, 131 and an engaging ring 140 are arranged between the housing main body 11 and the valve body 100. The engaging ring 140 serves as an engaging member. The seal members 130, 131 are arranged between the inner wall of the housing main body 11 and the outer wall of the valve body 100, thereby liquid tightly sealing the housing main body 11 and the valve body 100 therebetween. Namely, the seal members 130, 131 make contact closely with both the inner wall of the housing main body 11 and the outer wall of the valve body 100, thereby regulating the intrusion of the fuel from the compression chamber 15 into the solenoid actuator 60. The engaging ring 140 is formed in a substantially annular shape. The engaging ring 140 is engaged with a groove 24 formed in the inner wall of the housing main body 11 defining the through hole portion 20, and engaging with a groove 103 formed in the outer wall of the valve body 100. The valve body 100 is held in the housing main body 11 by engaging the engaging ring 140 with both the housing main body 11 and the valve body 100. The seal members 130, 131 and the engaging ring 140 construct a regulating member.

A washer 150, which serves as a bias member, is arranged between the valve body 100 and the step face 17. The washer 150 is a spring washer, for example, for pressing the valve body 100 to the side of the solenoid actuator 60 by resilient force. The valve body 100 is pressed to the side of the solenoid actuator 60 by the resilient force of the washer 150. The valve body 100 is held in the housing main body 11 by the engaging ring 140 engaged with the housing main body 11. Therefore, the valve body 100 may be slightly moved in the axial direction by a manufacturing error in sizes of the groove 24, the groove 103, the engaging ring 140, and the like, for example. When pressure of fuel in the compression chamber 15 changes as the plunger 13 upwardly and downwardly moves, force applied to the valve body 100 also changes by the fuel pressure. As a result, the valve body 100 may be moved in the axial direction thereof, consequently, ablation may arise in the seal members 130, 131 and the engaging ring 140 arranged between the housing main body 11 and the valve body 100. However, in the above structure, the movement of the valve body 100 can be reduced by pressing the valve body 100 to the solenoid actuator 60 using the washer 150. Accordingly, the ablation of the seal members 130, 131 and the engaging ring 140 can be reduced.

In the fifth embodiment, the high pressure fuel in the compression chamber 15 is sealed by the seal members 130, 131, thereby being restricted from entering the solenoid actuator 60. In the above construction, force from the high pressure fuel in the compression chamber 15 can be escaped to the housing main body 11 through the plug 120, the valve body 100, and the engaging ring 140. Therefore, force applied from the high pressure fuel in the compression chamber 15 can be restricted form being applied to the solenoid actuator 60. Consequently, the solenoid actuator 60 need not be enhanced in pressure resisting property and rigidity. Accordingly, the physical structure of the solenoid actuator 60 can be downsized.

In the above structure of the fifth embodiment, the regulating member 130, 131, 140 has the engaging ring 140 engaged with the outer wall of the valve body 100 and the inner wall of the housing main body 11. The regulating member 130, 131, 140 holds the valve body 100 in the housing main body 11. The regulating member 130, 131, 140 further includes the seal member 130, 131 for sealing the outer circumferential face of the valve body 100, which is for guiding the movement of the plug 51, and the inner circumferential face of the housing main body 11, which defines the fuel passage, therebetween. Thus, pressure of the fuel pressurized in the compression chamber 15 can be restricted from being applied to the solenoid actuator 60. Consequently, the hydraulic pressure applied from the compression chamber 15 to the solenoid actuator 60 can be reduced without causing complicatedness of the structure. Therefore, the rigidity of the solenoid actuator 60 need not be enhanced, and the physical structure of the solenoid actuator 60 need not be jumboized. Accordingly, the hydraulic pressure applied to the solenoid actuator 60 can be reduced by the simple structure, while restricting the solenoid actuator 60 from being jumboized.

Furthermore, the valve body 100 is held in the housing main body 11 by the engaging ring 140. In this structure, force generated by pressure of fuel in the compression chamber 15 is applied from the valve body 100 to the housing main body 11 via the engaging ring 140. Therefore, force generated by pressure of fuel in the compression chamber 15 can be restricted from being transmitted to the solenoid actuator 60. Accordingly, the rigidity of the solenoid actuator 60 need not be enhanced, and the physical structure of the solenoid actuator 60 need not be jumboized.

In the above structure of the fifth embodiment, the washer 150 is arranged between the step face 17 and the valve body 100. The washer 150 presses the valve body 100 to the side of the solenoid actuator 60, so that force is regularly applied to the valve body 140 to the side of the solenoid actuator 60. Therefore, the axial movement of the valve body caused by the change in pressure in the compression chamber 15 can be reduced. Accordingly, ablation arising in the seal member and the engaging member due to the movement of the valve body 100 can be restricted.

Furthermore, the washer 150 is arranged between the housing main body 11 and the engaging ring 140. The washer 150 presses the valve body 100 to the side of the solenoid actuator 60. Thus, force is regularly applied to the valve body 100 and the engaging ring 140 to the side of the solenoid actuator 60. Therefore, the axial movement of the valve body caused by the change in pressure in the compression chamber 15 can be reduced. Accordingly, ablation arising in the seal member and the engaging member caused by the movement of the valve body 100 can be reduced.

Figure 7:
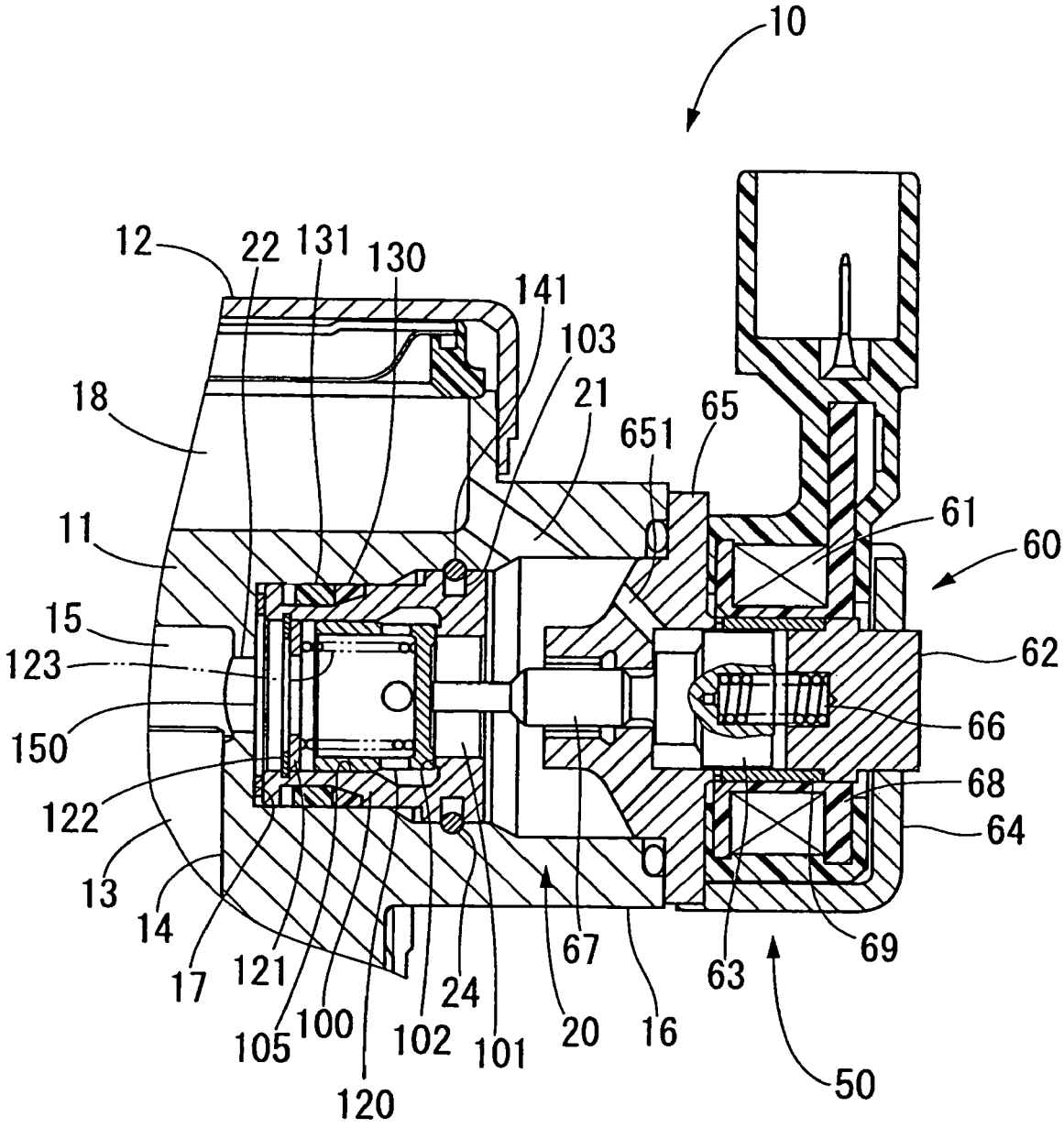
FIG. 7 is a partially cross-sectional side view showing a metering valve of a high pressure fuel pump, in accordance with a sixth embodiment of the present invention.

As shown in FIG. 7, in the sixth embodiment, an engaging ring 141 has the cross sectional shape, which is in a substantially circular shape.

Figure 8A:
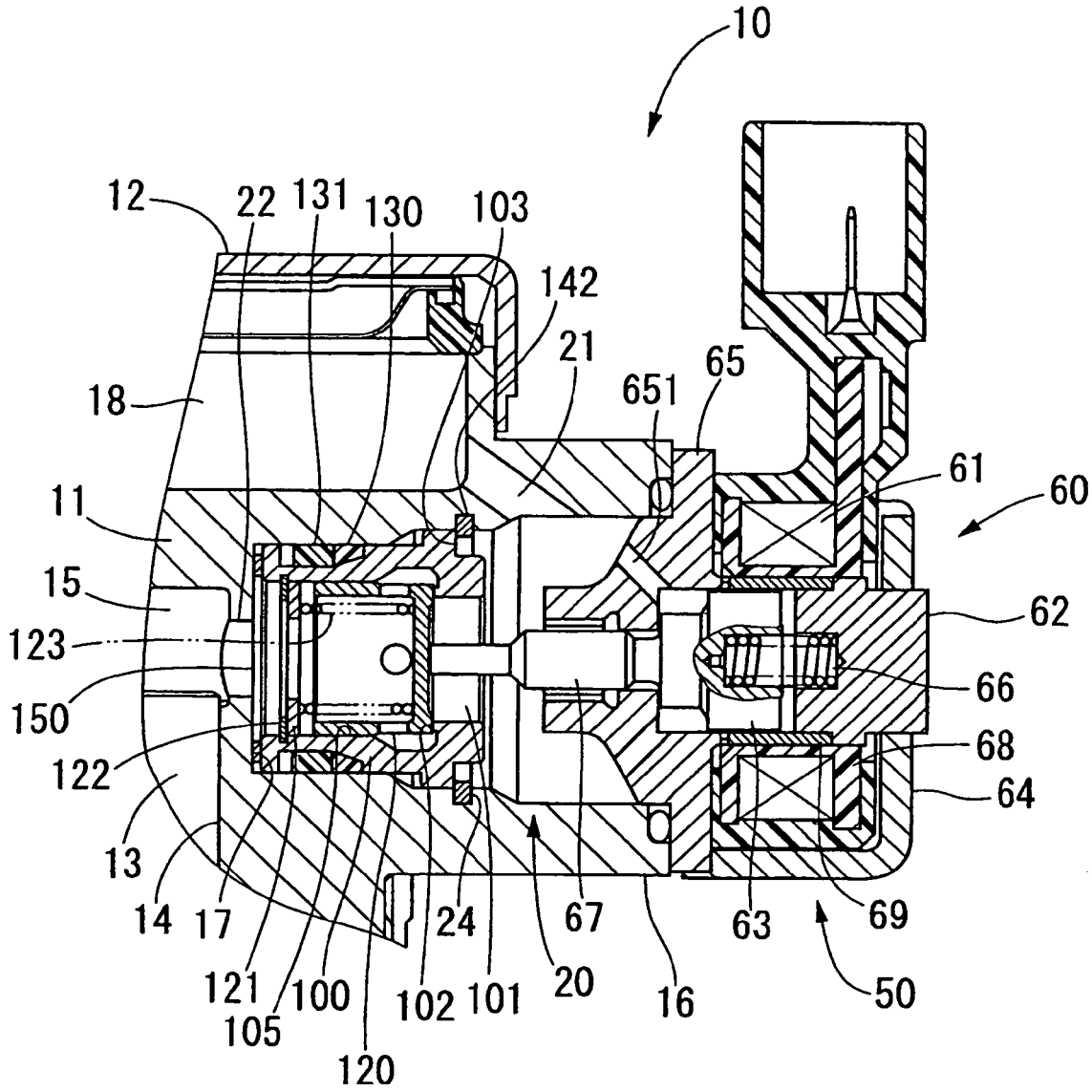
FIG. 8A is a partially cross-sectional side view showing a metering valve of a high pressure fuel pump.
Figure 8B:
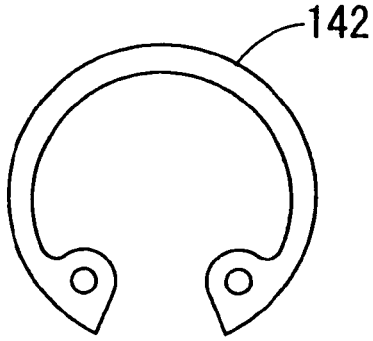
FIG. 8B is a schematic plan view showing an engaging ring of the high pressure fuel pump, in accordance with a seventh embodiment of the present invention.

As shown in FIGS. 8A, 8B, in the seventh embodiment, an engaging ring 142 is formed in a substantially arc shape having an opening portion with respect to the circumferential direction. That is, the engaging ring 142 is in an approximately C-shape.

The cross sectional shape and the planar shape can be arbitrarily set in the engaging rings 140, 141, 142.

Figure 9:
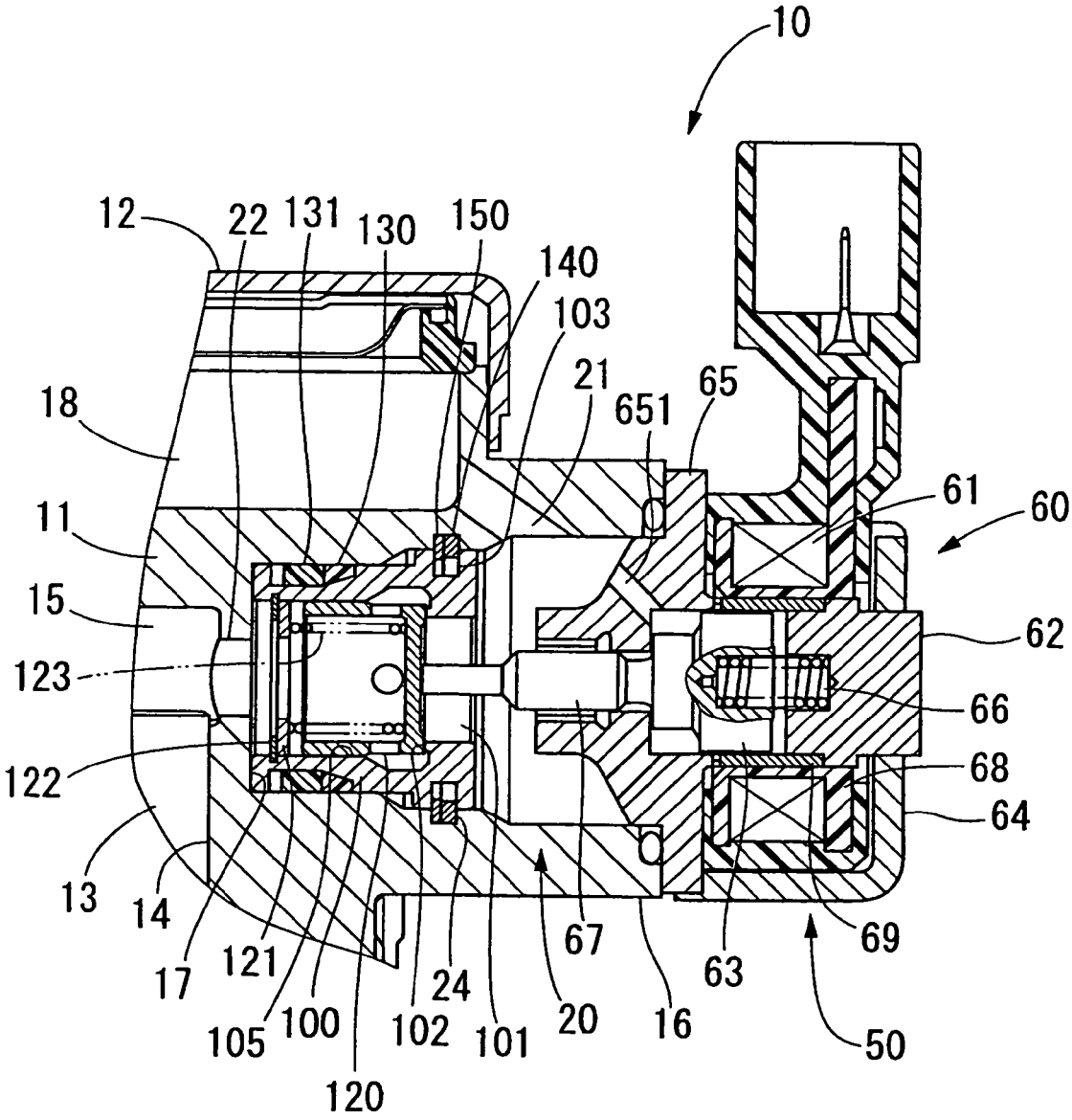
FIG. 9 is a partially cross-sectional side view showing a metering valve of a high pressure fuel pump, in accordance with an eighth embodiment of the present invention.

Eighth, Ninth, Tenth, Eleventh, Twelfth, Thirteenth, Fourteenth, Fifteenth, and Sixteenth Embodiments As shown in FIG. 9, in the eighth embodiment, a washer 150 is provided in the groove 24 of the housing main body 11 and the groove 103 of the valve body 100 together with the engaging ring 140. The washer 150 is arranged on the side of compression chamber 15 with respect to the engaging ring 140, thereby pressing the engaging ring 140 to the side of the solenoid actuator 60. Thus, the washer 150 presses the valve body 100 to the side of the solenoid actuator 60 via the engaging ring 140, thereby reducing a movement of the valve body 100.

Figure 10:
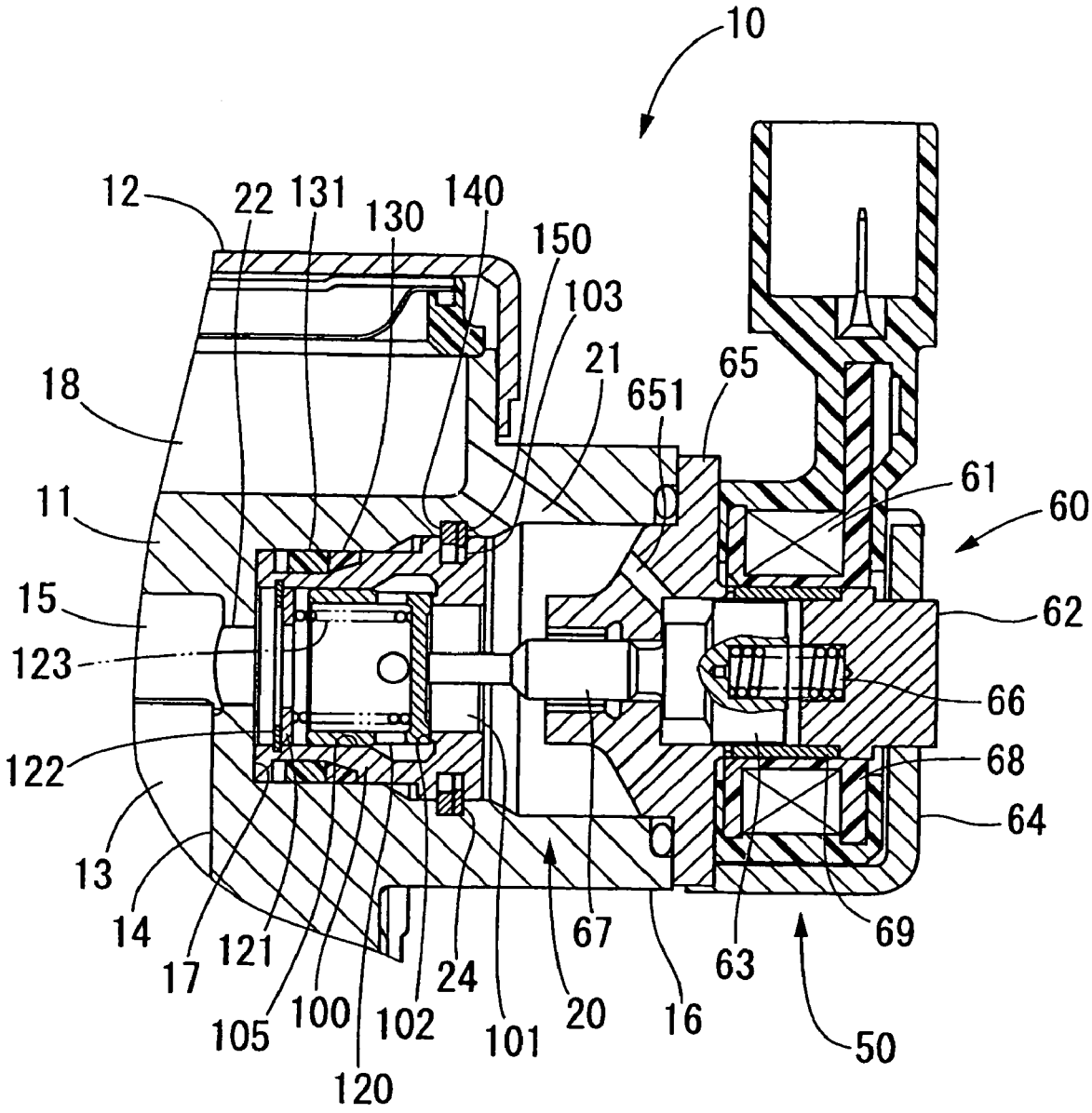
FIG. 10 is a partially cross-sectional side view showing a metering valve of a high pressure fuel pump, in accordance with a ninth embodiment of the present invention.

As shown in FIG. 10, in the ninth embodiment, the washer 150 is arranged in the groove 24 of the housing main body 11 and the groove 103 of the valve body 100 together with the engaging ring 140. The washer 150 is arranged on the side of the solenoid actuator 60 with respect to the engaging ring 140, thereby pressing the engaging ring 140 to the side of the compression chamber 15. Thus, the washer 150 presses the valve body 100 to the side of the step face 17 via the engaging ring 140, thereby reducing the movement of the valve body 100.

In this structure of the ninth embodiment, the washer 150 is arranged between the housing main body 11 and the engaging ring 140. The washer 150 presses the valve body 100 to the side of the step face 17. Thus, force is regularly applied to the valve body 100 and the engaging ring 140 to the side of the step face 17. Therefore, the axial movement of the valve body 100 caused by pressure change of the compression chamber 15 can be reduced. Accordingly, ablation arising in the seal member and the engaging ring 140 caused by the movement of the valve body 100 can be reduced.

Figure 11A:
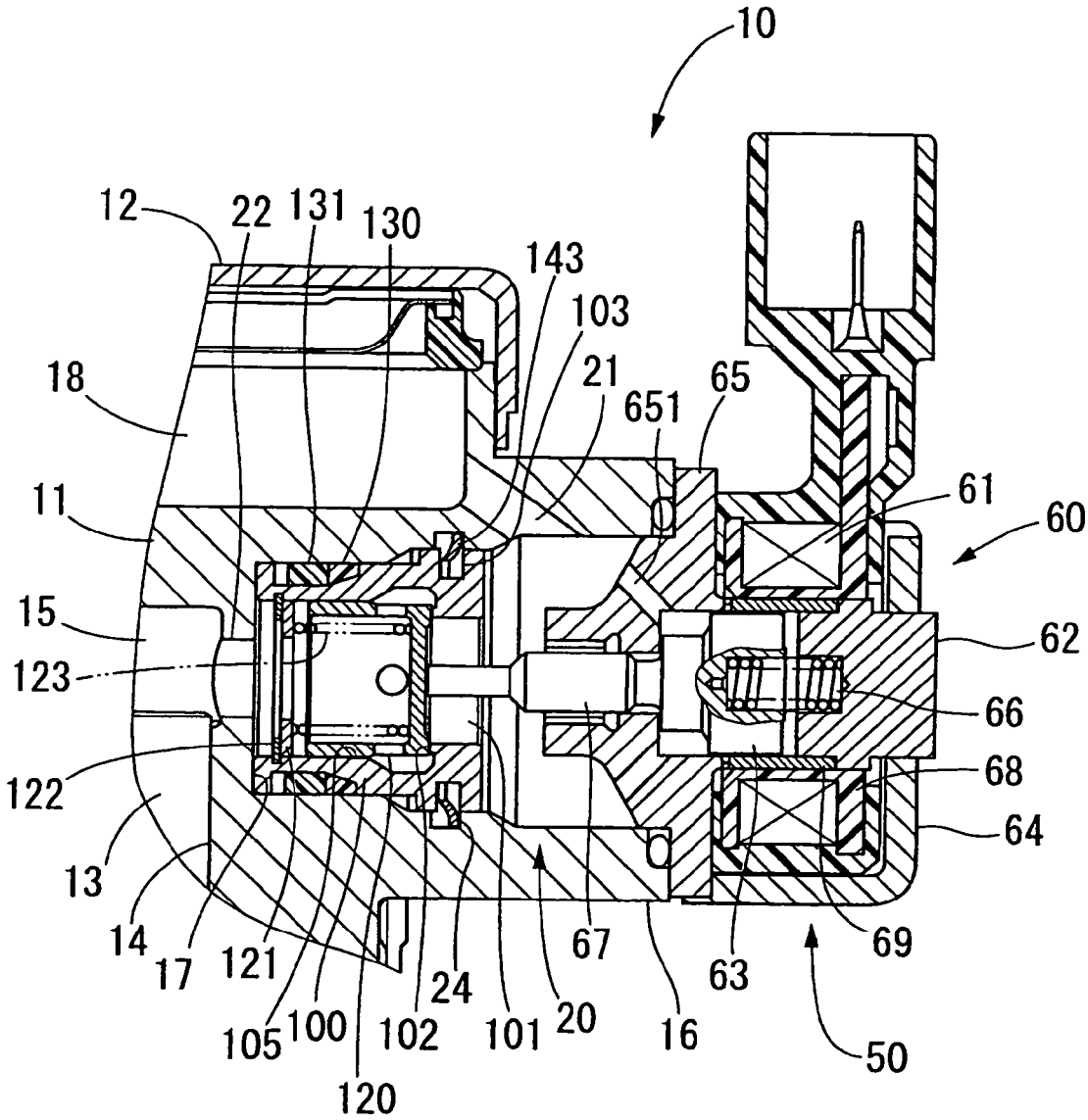
FIG. 11A is a partially cross-sectional side view showing a metering valve of a high pressure fuel pump.
Figure 11B:
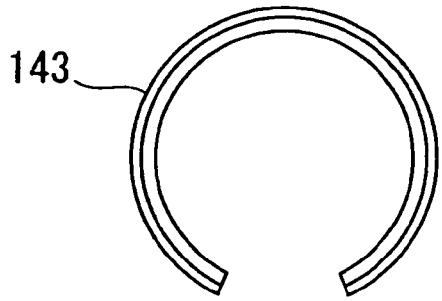
FIG. 11B is a schematic plan view showing an engaging ring of the high pressure fuel pump, in accordance with a tenth embodiment of the present invention.

As shown in FIGS. 11A, 11B, in the tenth embodiment, an engaging ring 143 produces resilient force for expanding and contracting this engaging ring 143 with respect to the axial direction thereof. Therefore, the engaging ring 143 holds the valve body 100 in the housing main body 11, thereby pressing the valve body 100 by the resilient force. In the tenth embodiment, the engaging ring 143 is arranged in the groove 24 of the housing main body 11 and the groove 103 of the valve body 100. In this structure, the engaging ring 143 presses the valve body 100 to the opposite side of the solenoid actuator 60. Thus, the valve body 100 is pressed against the step face 17 by the engaging ring 143.

Figure 12A:
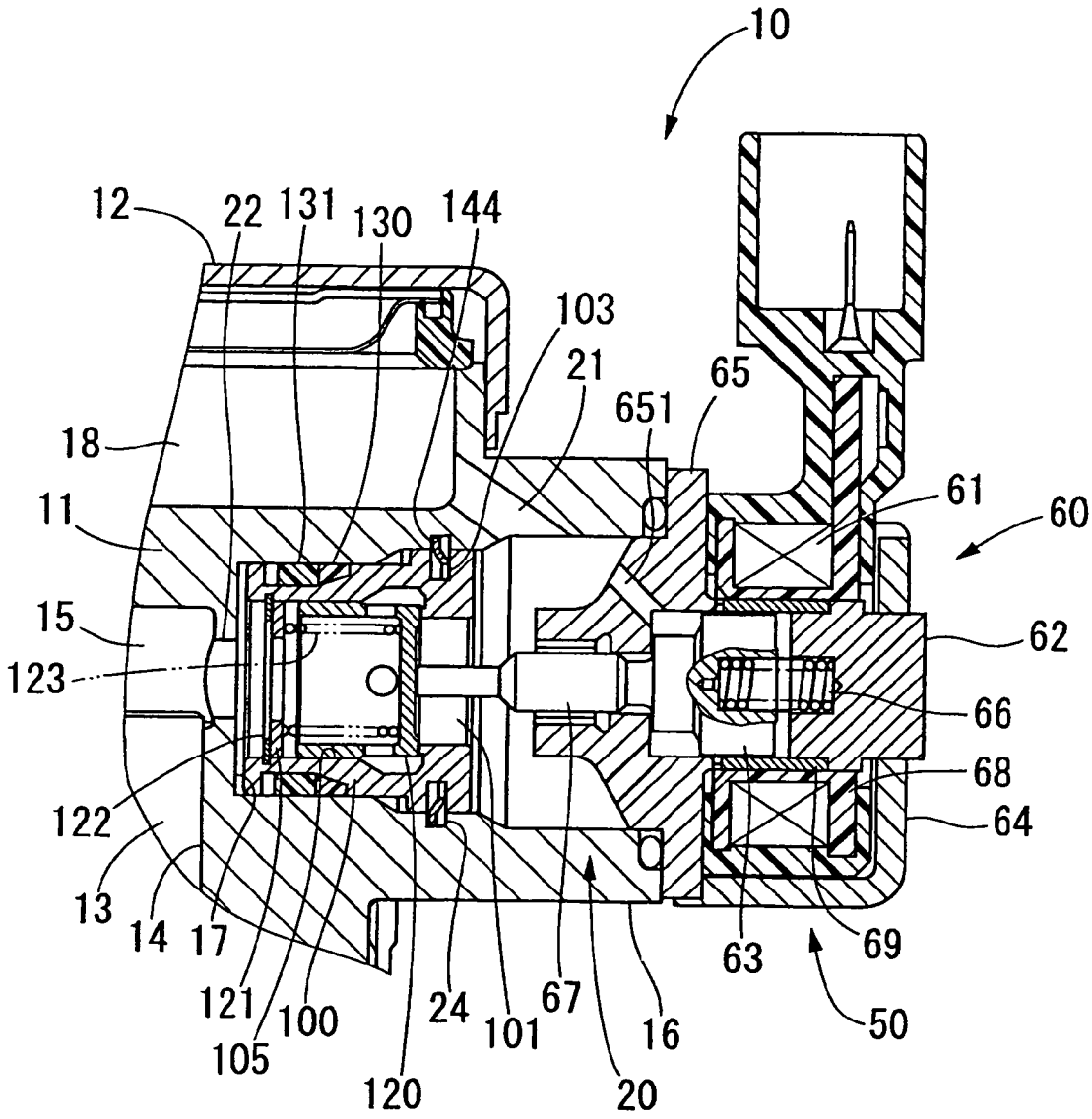
FIG. 12A is a partially cross-sectional side view showing a metering valve of a high pressure fuel pump.
Figure 12B:
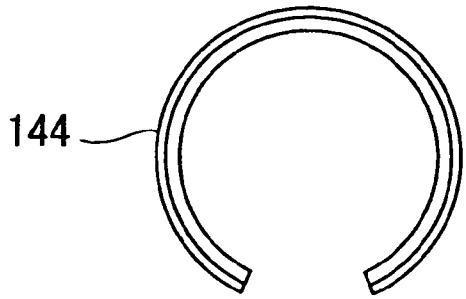
FIG. 12B is a schematic plan view showing an engaging ring of the high pressure fuel pump, in accordance with an eleventh embodiment of the present invention.

As shown in FIGS. 12A, 12B, in the eleventh embodiment, an engaging ring 144 presses the valve body 100 to the side of the solenoid actuator 60 reversely to the tenth embodiment.

In the structures of the tenth and eleventh embodiments, the engaging ring 143, 144 itself has resilient force. Therefore, the engaging ring 143, 144 presses the valve body 100 toward the solenoid actuator 60 or toward the step face 17. Thus, force is regularly applied from the engaging ring 143, 144 to the valve body 100 toward the solenoid actuator 60 or toward the step face 17 side. Consequently, the axial movement of the valve body 100 caused by pressure change of the compression chamber 15 can be reduced. Accordingly, ablation arising in the seal member and the engaging ring 143, 144 caused by the movement of the valve body 100 can be reduced.

Figure 13:
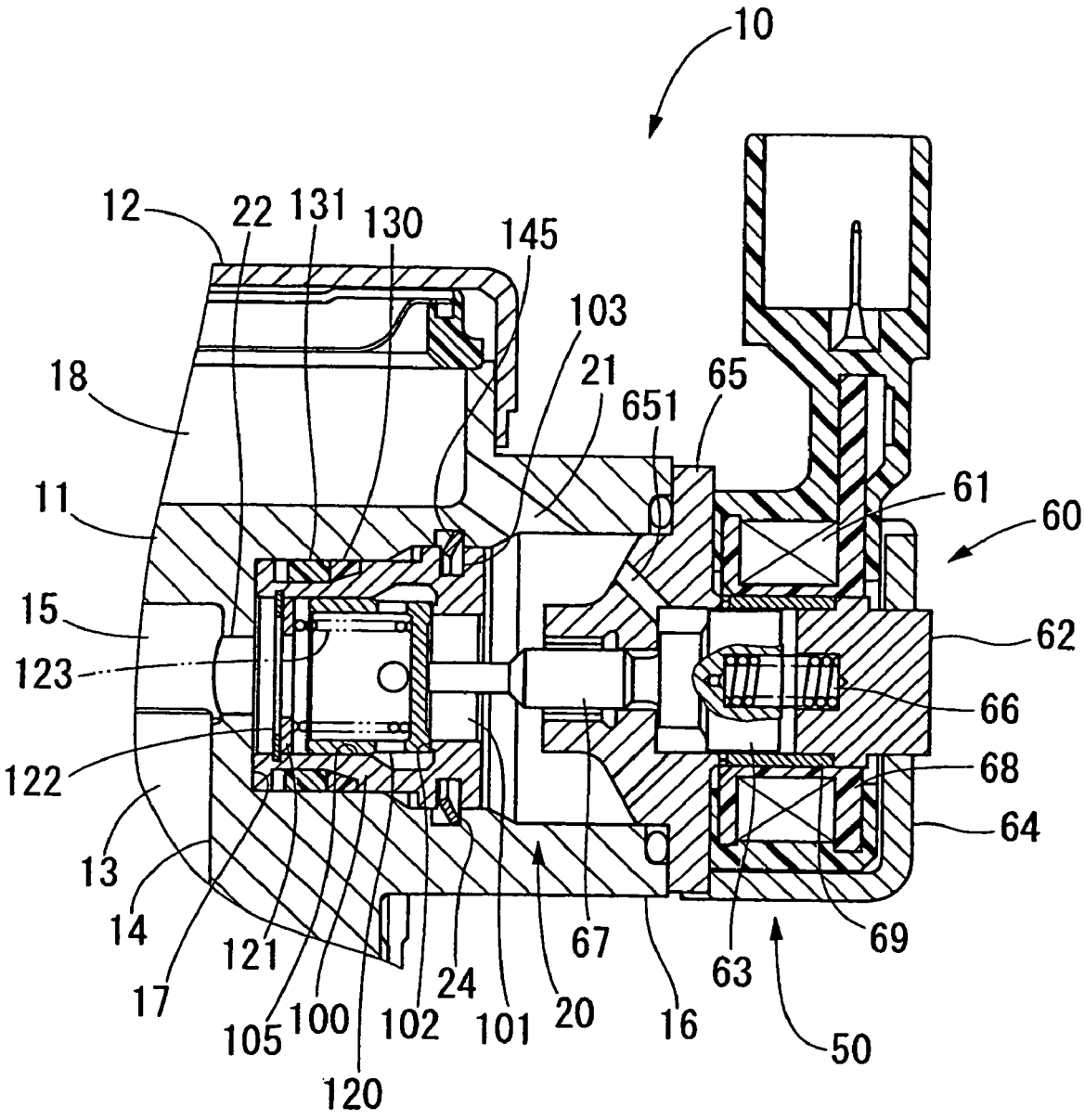
FIG. 13 is a partially cross-sectional side view showing a metering valve of a high pressure fuel pump, in accordance with a twelfth embodiment of the present invention.
Figure 14:
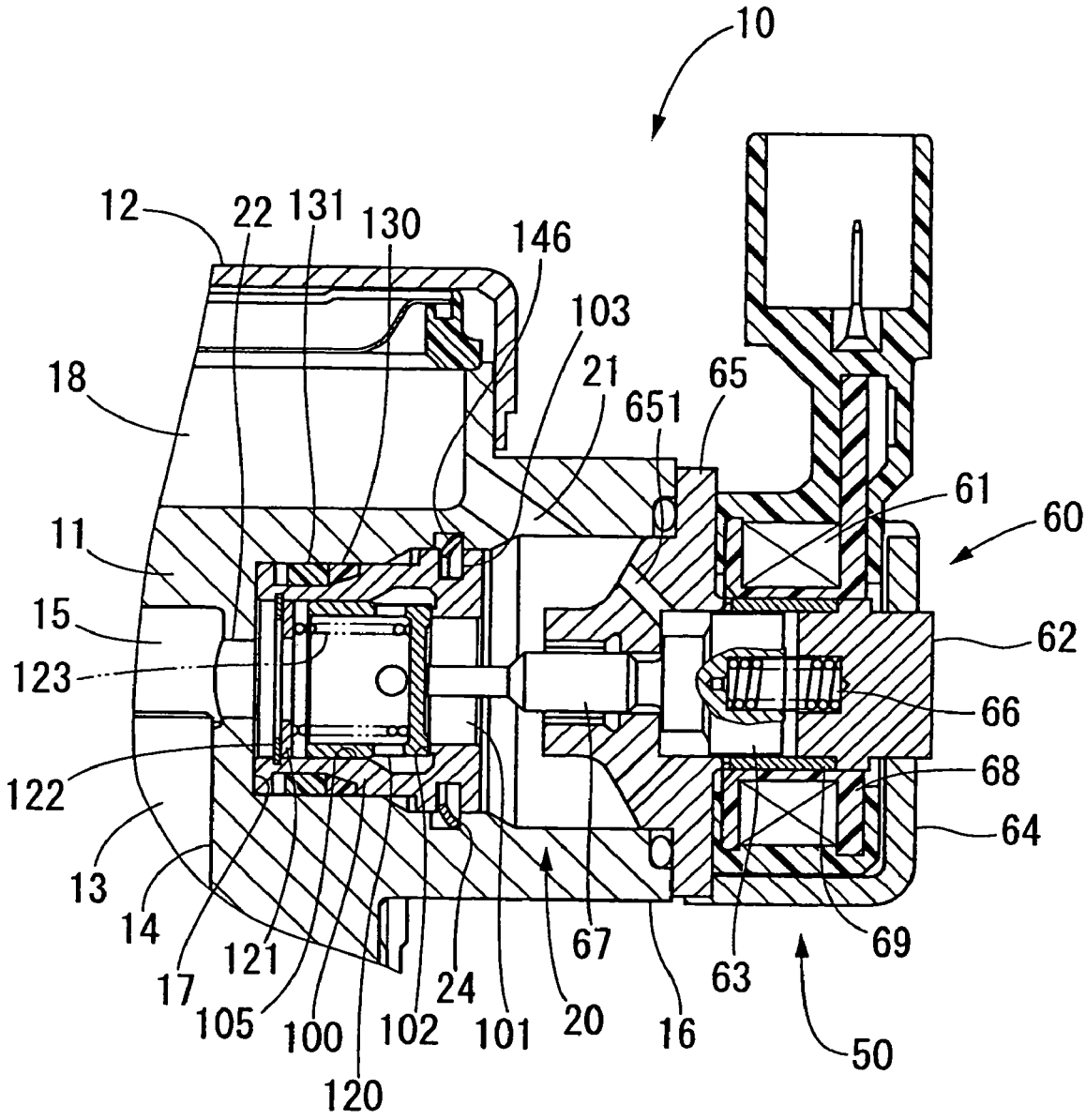
FIG. 14 is a partially cross-sectional side view showing a metering valve of a high pressure fuel pump, in accordance with a thirteenth embodiment of the present invention.
Figure 15:
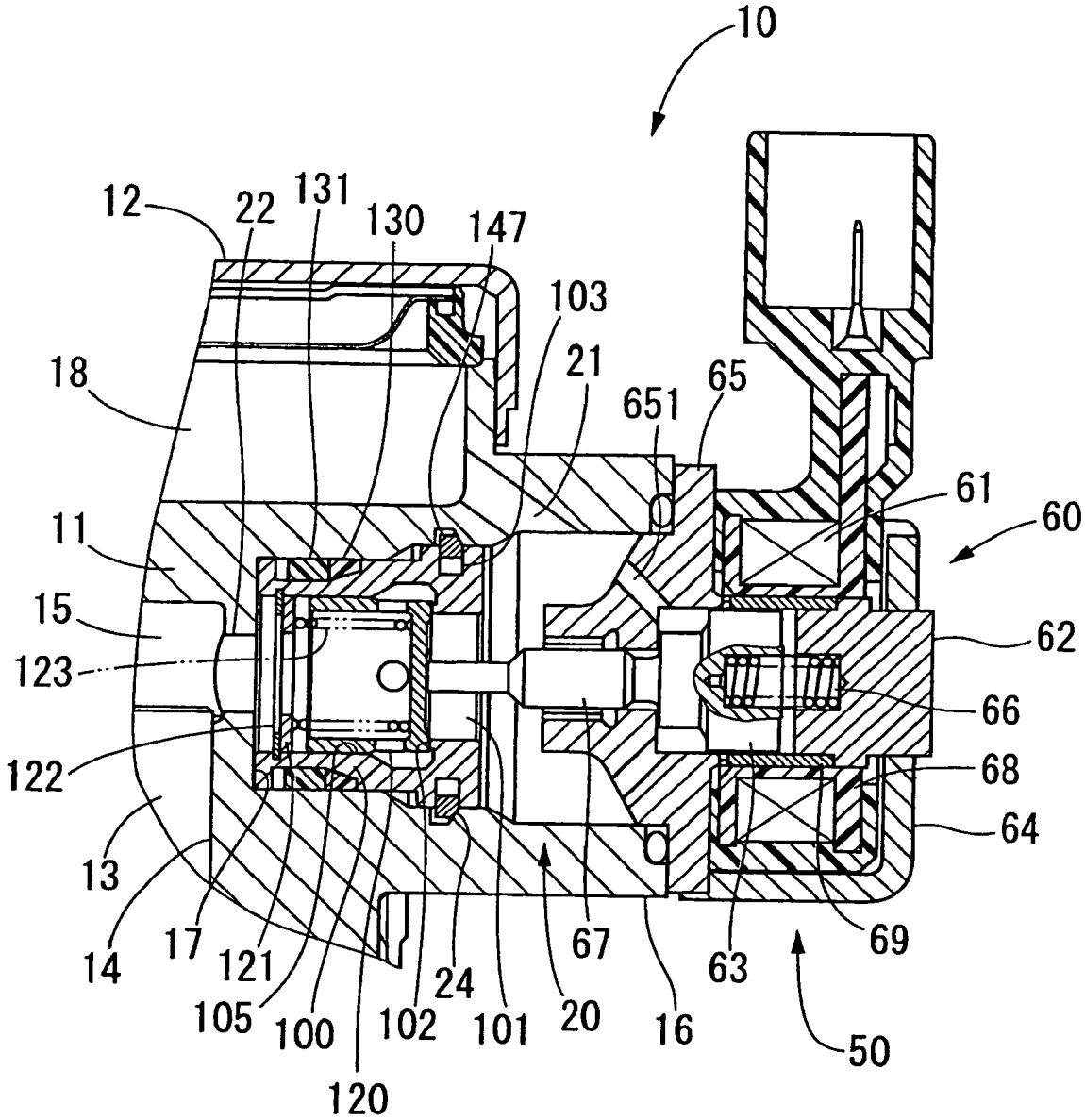
FIG. 15 is a partially cross-sectional side view showing a metering valve of a high pressure fuel pump, in accordance with a fourteenth embodiment of the present invention.

As respectively shown in FIG. 13, 14 or 15, in the twelfth, thirteenth and fourteenth embodiments, the cross sectional shapes of engaging rings 145, 146 and 147 are different from the cross sectional shape of the tenth embodiment. In the structures of the twelfth, thirteenth and fourteenth embodiments, the pressing direction of the valve body 100 is similar to that of the tenth embodiment. Thus, the cross sectional shape of the engaging ring can be arbitrarily selected.

In the tenth to fourteenth embodiments, a washer for pressing the valve body 100 can be omitted. Accordingly, the number of components can be reduced.

Figure 16A:
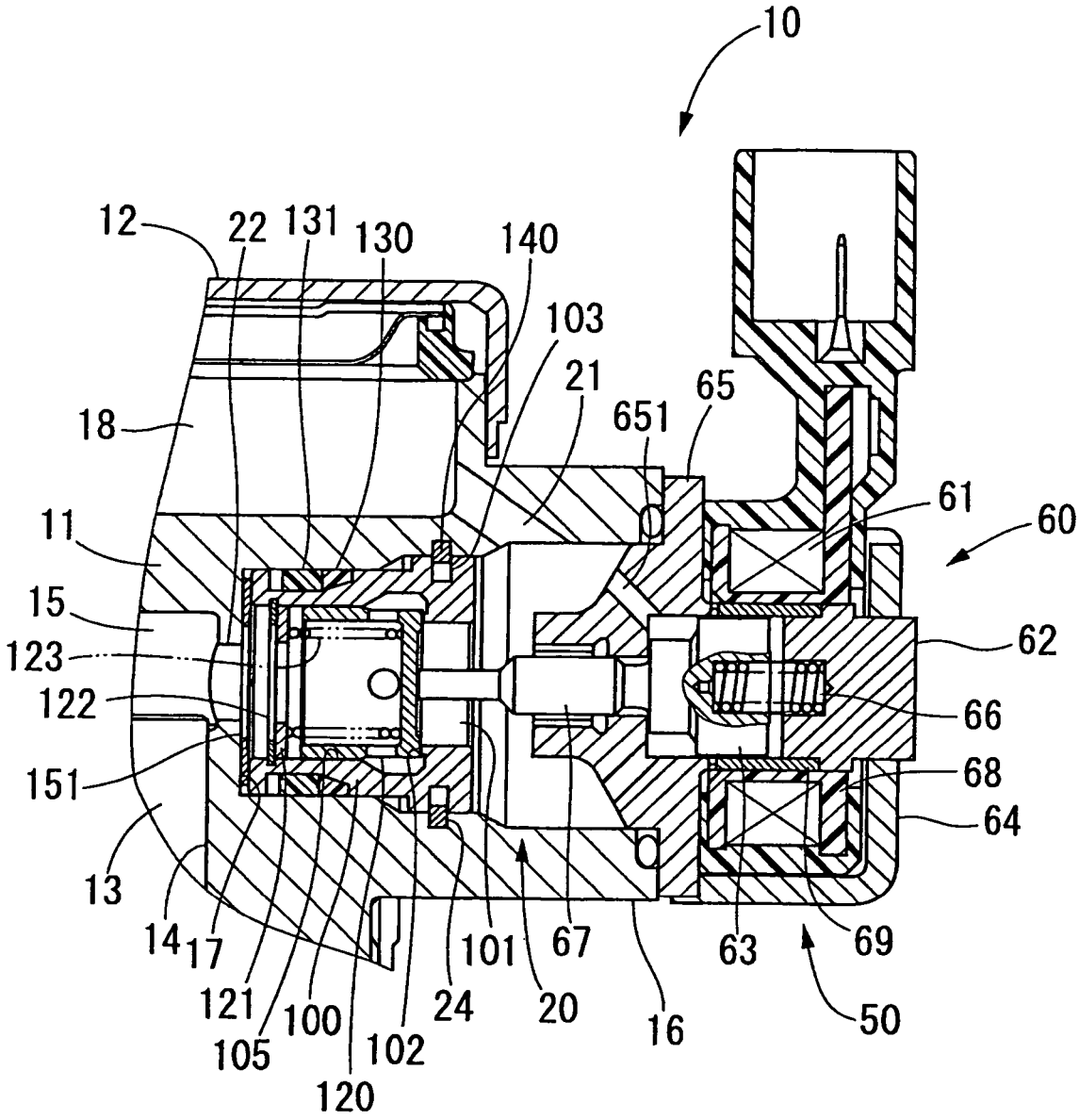
FIG. 16A is a partially cross-sectional side view showing a metering valve of a high pressure fuel pump.
Figure 16B:
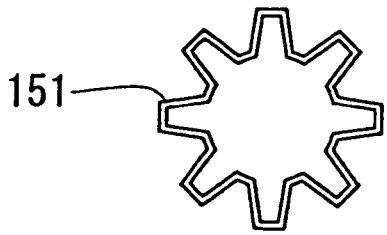
FIG. 16B is a schematic plan view showing a washer of the high pressure fuel pump, in accordance with a fifteenth embodiment of the present invention.

In the fifteenth embodiment, as shown in FIGS. 16A, 16B, a washer 151 has the planar shape, which is different from the planar shapes of the other embodiments. For example, as shown in FIG. 16B, the washer 151 may have a star shape and a polygonal shape.

Figure 17:
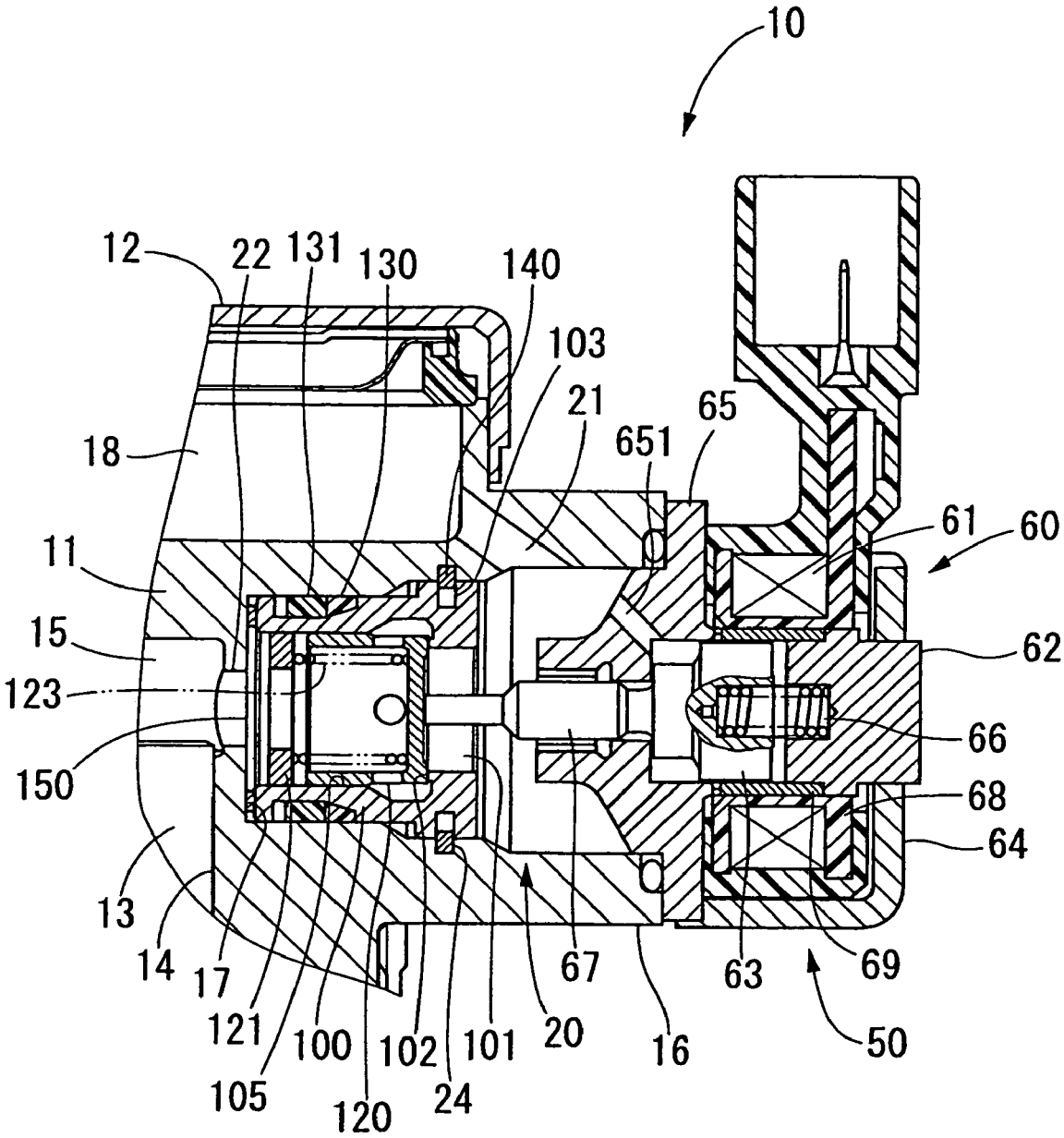
FIG. 17 is a partially cross-sectional side view showing a metering valve of a high pressure fuel pump, in accordance with a sixteenth embodiment of the present invention.

In the sixteenth embodiment, as shown in FIG. 17, a spring seat 121 is press-fitted to the inner circumferential side of the valve body 100. Thus, an engaging member for fixing the spring seat 121 to the valve body 100 can be omitted. Accordingly, the number of components can be reduced.

Other Embodiments

In the above first and third embodiments, the construction for fixing the seat member 30 to the housing main body 11 by screw connection has been described. In these structures, an end portion of the seat member 30 on the side of the solenoid actuator 60 may be welded to the housing main body 11.

The fluid pressurized using the high pressure pump is not limited to fuel.

The above structures of the embodiments can be combined as appropriate.

Various modifications and alternations may be diversely made to the above embodiments without departing from the spirit of the present invention.

What is claimed is:

1. A pump comprising:

a housing that has a compression chamber for pressurizing fluid, the housing further having a fluid passage for guiding fluid into the compression chamber;

a valve that is located midway through the fluid passage, the valve being adapted to communicating the fluid passage, the valve including a valve body and a plug selectively seated on a seat face of the valve body, the valve being adapted to blocking the fluid passage when the plug engages the seat face of the valve body;

a solenoid actuator that is located on a substantially opposite side of the valve with respect to the compression chamber, the solenoid actuator being adapted to operate the valve; and a regulating member that is located between compression chamber and the solenoid actuator for regulating intrusion of fluid from the compression chamber around the valve body and into the solenoid actuator, wherein the regulating member includes a seal member and an engaging member, the seal member is located between an outer circumferential periphery of the valve body and an inner circumferential periphery of the housing, the engaging member is adjacent to the outer circumferential periphery of the valve body and engaged with both the valve body and the housing, the engaging member holds the valve body at a fixed position relative to the housing, the seal member is in contact with both the outer circumferential periphery of the valve body and the inner circumferential periphery of the housing, the engaging member is directly in contact with an end of the valve body on a side of the solenoid actuator, and the engaging member is a washer substantially in a C-shape.

* * * * *